US007363230B2

(12) United States Patent
Matsunuma

(10) Patent No.: US 7,363,230 B2
(45) Date of Patent: Apr. 22, 2008

(54) AUDIO DATA PROCESSING APPARATUS AND AUDIO DATA DISTRIBUTING APPARATUS

(75) Inventor: Yasuhiro Matsunuma, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 773 days.

(21) Appl. No.: 10/629,306

(22) Filed: Jul. 29, 2003

(65) Prior Publication Data

US 2004/0024592 A1 Feb. 5, 2004

(30) Foreign Application Priority Data

Aug. 1, 2002 (JP) ..... 2002-225102
Sep. 27, 2002 (JP) ..... 2002-282977
Sep. 30, 2002 (JP) ..... 2002-286843

(51) Int. Cl.
*G10L 19/00* (2006.01)
*G10L 21/00* (2006.01)

(52) U.S. Cl. ..... 704/500

(58) Field of Classification Search ..... 704/500
See application file for complete search history.

(56) References Cited

U.S. PATENT DOCUMENTS 5,696,875 A * 12/1997 Pan et al. ..... 704/219
5,970,443 A * 10/1999 Fujii ..... 704/222
6,263,312 B1 * 7/2001 Kolesnik et al. ..... 704/500
6,691,082 B1 * 2/2004 Aguilar et al. ..... 704/219
2001/0021879 A1 * 9/2001 Miyasaka et al. ..... 700/94
2002/0116199 A1 * 8/2002 Wu et al. ..... 704/500
2002/0165709 A1 * 11/2002 Sadri et al. ..... 704/201
2002/0178012 A1 * 11/2002 Wang et al. ..... 704/503

FOREIGN PATENT DOCUMENTS

JP 10-154000 6/1998
JP 11-261534 9/1999

OTHER PUBLICATIONS

Japanese Patent Office ("Notice of Reasons of Rejection"), Issue No. 140964, dated Mar. 27, 2007.
Japanese Patent Office ("Notice of Reasons of Rejection"), Issue No. 525120, dated Nov. 21, 2006.

* cited by examiner

*Primary Examiner*—David Hudspeth
*Assistant Examiner*—Justin W. Rider
(74) *Attorney, Agent, or Firm*—Pillsbury Winthrop Shaw Pittman LLP

(57) ABSTRACT

A distribution unit 1 divides PCM audio data in plurality of divided data. Each divided data has overlapping sections overlapping with previous and following divided data. An MP3 encoding unit 2 encodes each divided data individually into MP3 data. A filtering process at the time of encoding is executed by using the overlapping sections as similar to before the division of the data. An analyzing unit 3 analyzes the overlapping sections of each divided data encoded into the MP3 data and searches a frame where main data (bit storage values) are not overlapping. A combiner unit 4 combines the adjoining divided data at the searched frames as combining frames. Although the audio data is divided and the divided data are encoded to MP3 data by parallel processes, a continuity of the data and compressing quality can be maintained.

11 Claims, 17 Drawing Sheets

AUDIO DATA PROCESSING APPARATUS AND AUDIO DATA DISTRIBUTING APPARATUS

CROSS REFERENCE TO RELATED APPLICATION

This application is based on Japanese Patent Application 2002-225102, filed on Aug. 1, 2002, Japanese Patent Application 2002-282977, filed on Sep. 27, 2002, and Japanese Patent Application 2002-286843, filed on Sep. 30, 2002, the entire contents of which are incorporated herein by reference.

BACKGROUND OF THE INVENTION

A) Field of the Invention

This invention relates to an audio data processing apparatus that encodes PCM audio data into MP3 audio data and an audio data streaming server that distributes streams of the audio data.

B) Description of the Related Art

Mpeg Audio Layer 3 (MP3) is likely to be used for a data format in a streaming distribution of audio data on a local area network (LAN) or the Internet. By using MP3 data, it is possible to achieve a sound quality almost similar to Pulse Code Modulated (PCM) audio data with about 1/11 of data size of the PCM audio data, i.e., a bit rate at 128 kbps. A server distributing the MP3 audio data (audio server) stores audio data encoded into the MP3 format and streams the stored MP3 audio data to a client device (a terminal device) upon a distribution request form the client device.

The MP3 data is not fixed to the 128 Kbps bit rate, but various bit rates such as 64 Kbps, etc. may be used for encoding the audio data. Also, Variable Bit Rate (VBR) encoding style wherein the bit rate is changed in one piece of music is in practical use. For example, in the VBR encoding style, the bit rate is lowered in a silent part of the music to save an amount of the data whereas the bit rate is raised in a complicated part of the music to improve reproducibility of musical tone. The VBR encoding style can improve the sound quality comparing to Constant Bit Rate (CBR) encoding style when the amounts of the data are the same.

In a case of encoding the PCM audio data into the MP3 audio data, it takes much time although a fast CPU is used when a high quality encoding is necessary. In the high quality MP3 encoding, an audio signal is divided into a multiplicity of frequency sub-bands, and a filtering process considering adjoining frames of the target frame is executed to the divided signals by Modified Discrete Cosine Transform (MDCT) in order to reflect characters of a frequency distribution with high definition. Also, a bit storage method us used for assigning larger amount of the data to an important part of the audio data, wherein main data is made larger or smaller than a frame size.

There is a request to make the MP3 encoding much faster, and a parallel processing of a plurality of processors by dividing the audio data is considered to make the faster MP3 encoding possible. However, in the above-described conventional techniques, the filtering process is executed with considering adjoining frames of the target frame. Therefore, if the audio data is divided, existence or lack of the adjoining frame may affect the process of the frame near the dividing point. Moreover, when the bit storage is performed, the encoded data (main data) may be arranged in a data frame different from the original data frame and therefore, the decoded data may be discontinuous by a simple division and combining of the data.

The process for encoding the PCM audio data into the high quality MP3 data takes a bunch of times, and other process cannot be executed while the processor is occupied by the encoding process. Therefore, when a necessity of executing the other process may occur, it cannot be processed until the encoding process finishes. Further, in the conventional encoding techniques, when the music data (the PCM audio data) is encoded into the MP3 data, the music data for one song as a whole is an encoding target. Therefore, the time for one encoding process is very long, and the waiting time for-the process becomes very long.

Moreover, because the MP3 encoding process is executed with reference to the adjoining data, when the process is interrupted the encode process that has been already executed is abandoned, the whole process has to be executed again from the beginning. Therefore, the interruption by the other process make the encoding process wasted.

Further, although it is possible to execute the MP3 encoding process efficiently when the plurality of the processor are used, a technique wherein the different music data are processed by the different processor also cannot execute the other process until the MP3 encoding process of each processor finishes. Although the encoding time for one piece of the music becomes drastically short when the plurality of the processors are connected by a pipeline connection to execute a pipeline process, it is impossible to assign the interrupting process dynamically to a part of the processors because all of the processors are used for the MP3 encoding process.

When the music data is distributed via a communication network, especially via a wireless communication such as a wireless LAN, a condition of the communication network varies depending on a condition of radio wave transmission and congestion. Therefore, the bit rate possible to be used for the transmission varies. However, the conventional audio server just stores the MP3 data, and so the bit rate cannot be changed according to the network condition.

Especially, the network condition changes every moment while the audio data for one piece of music is distributed; however, the bit rate cannot be changed in correspondence with the change of the network condition during the distribution of the music data. Although there is MP3 data encoded in the VBR style wherein the bit rate changes during the music, the VBR style encoding changes the bit rate according to the condition of the musical tone but not in correspondence with the network condition.

SUMMARY OF THE INVENTION

It is an object of the present invention to provide an audio data processing apparatus that can execute a distributed process to data while maintaining a quality of encoding and continuity of the data.

It is another object of the present invention to provide an audio data processing apparatus that can execute an encoding process to audio data efficiently while assigning the encoding process and other process dynamically.

It is further object of the present invention to provide an audio data distributing apparatus that can distribute audio data with changing bit rate dynamically in correspondence with a condition of a communication network.

According to one aspect of the present invention, there is provided an audio data processing apparatus, comprising: a dividing device that divides PCM audio data into plurality of divided data, each divided data having overlapping sections overlapping with previous and following divided data; an encoder that encodes the divided data one by one; an analyzer that decides combining points where each encoded divided data can be recombined without overlapping with others within the overlapping sections; and a combining device that combines the divided data at the decided combining points.

When the audio data is simply divided by a time axis into the divided data, a filtering process at a time of data encoding will be different from the filtering process to the original audio data because there are no adjoining data around dividing points. Also, main data of a frame may be moved to different frame in the MP3 format.

Therefore, according to the above-described audio data processing apparatus, the overlapping sections are set in each divided data and are included in a filtering process sections in order to make the filtering process at a time of data encoding the same as the filtering process to the original audio data. Moreover, by comparing moving amounts of previous and following divided data, combining points where the data are not overlapping. By combining the divided data at the combining points, the data will be continuous when the divided data individually encoded are combined again.

According to another aspect of the present invention, there is provided an audio data processing apparatus, comprising: a dividing device that divides PCM audio data into plurality of divided data, each divided data having overlapping sections overlapping with previous and following divided data; a plurality of processors that encodes the divided data and execute other process; a detector that detects a free processor by watching loading conditions of the plurality of the processors; a supplier that supplies the divided data to be encoded to the free processor; an analyzer that decides combining points where each encoded divided data can be recombined without overlapping with others within the overlapping sections; and a combining device that combines the divided data at the decided combining points.

According to the above-described audio data processing apparatus, the PCM audio data is divided into plurality of the divided data, and when there is a free processor that is not executing any processes in the plurality of the processors, each divided data is individually encoded by the free processor. By using a free time of the plurality of the processors, the encoding process and other process can be executed in parallel; therefore, efficient use of the processors and efficient encoding can be realized. Also, the divided data are of course shorter than the whole data, and so waiting time can be shorter when the request of other process is detected.

In the above-described audio data processing apparatus, when the PCM audio data is encoded into the MP3 data, because the encoding process is executed with reference not only to the data to be encoded but also to the adjoining data, the contents of data in the edges of the divided data will be difference from that of non-divided data. Therefore, the PCM audio data is divided into the divided data having overlapping sections overlapping with previous and following divided data, and the divided data are individually encoded into the MP3 data. After encoding, the divided data are re-combined by overlapping the overlapping sections with abandoning the data in the edge in order to make the encoded data that is similar to the data encoded without dividing process. By that, the encoded data similar to the data encoded continuously can be obtained when the data is once divided. Also, processing time for one divided data can be shortened; therefore, the waiting time for other process can be shortened.

According to further aspect of the present invention, there is provided an audio data distributing apparatus, comprising: a dividing device that divides audio data into a plurality of divided data; an encoding device that encodes the divided data; a transmitter that transmits the encoded divided data; a detecting device that detects a condition of a communication network; and an instructor that instructs a bit rate suited for the detected condition of the communication network to the encoder at a time of encoding each divided data.

According to the above described audio data distributing apparatus, the plurality of the divided data into which the audio data for one piece of music is divided are supplied to the encoder. The encoder encodes the divided data, i.e., the divided audio data, to the transmitter and can vary bit rate of the encoding. The instructor instructs a bit rate suited for the condition of the communication network detected by the detector to the encoder at a time of encoding each divided data. Because the audio data is divided into the plurality of the divided data, the bit rate can be decided just before encoding/transmitting each divided data in accordance with the condition of the communication network; therefore, the optimized bit rate suited for current condition of the communication network can be selected.

According to the present invention, the PCM audio data can be divided and encoded in parallel; therefore, the fast encoding process will be possible with maintaining continuity of the data and quality of compression.

Further, according to the present invention, the PCM audio data is divided in to the plurality of the divided data, and each divided data is encoded by using the free processor. Therefore, efficiency of using the processors can be improved. Also, encoding process is executed according to unit of the divided data; therefore, occupying time of each encoding process can be shortened, and the encoding process does not interfere the other process.

Moreover, according to the present invention, the PCM audio data is divided in to the plurality of the divided data, and each divided data is encoded and distributed by streaming with changing bit rate in accordance with the condition of the communication network. Therefore, it is possible to realize streaming of the audio data at the optimized bit rate in accordance with the changing condition of the communication network.

DETAILED DESCRIPTION OF THE PREFERRED EMBODIMENTS

Figure 1A:
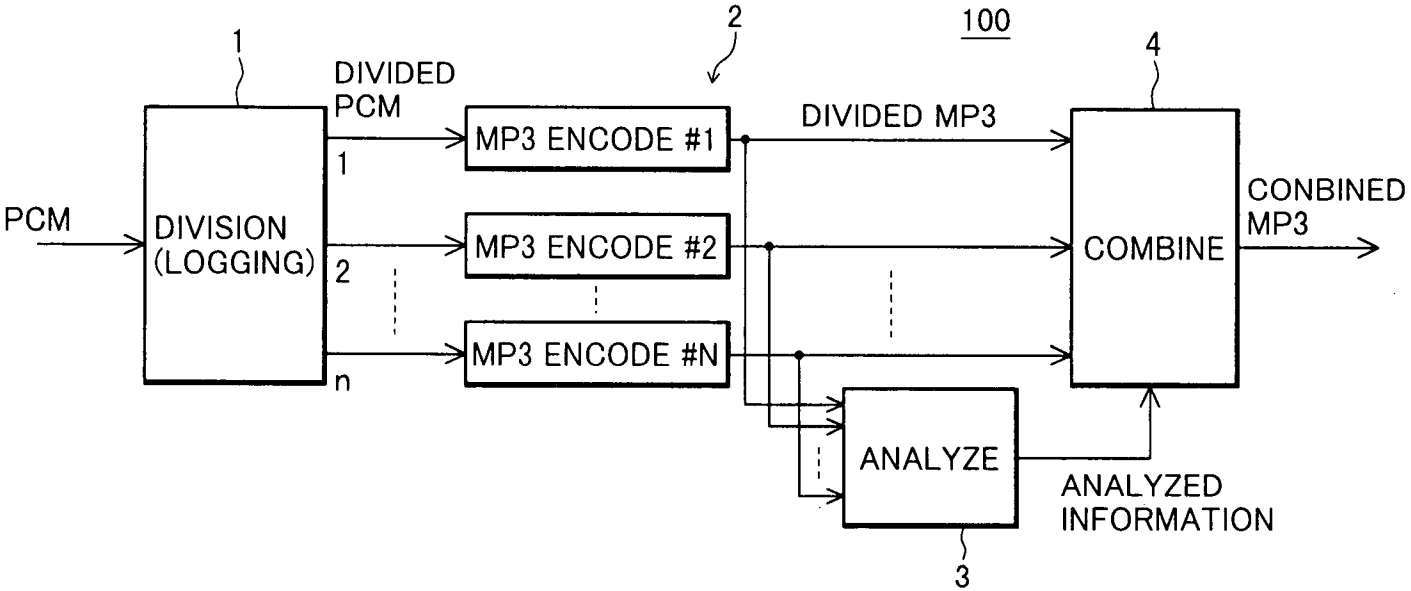
FIGS. 1A and 1B are schematic block diagrams showing an MP3 encoding system 100 according to a first embodiment of the present invention.
Figure 1B:
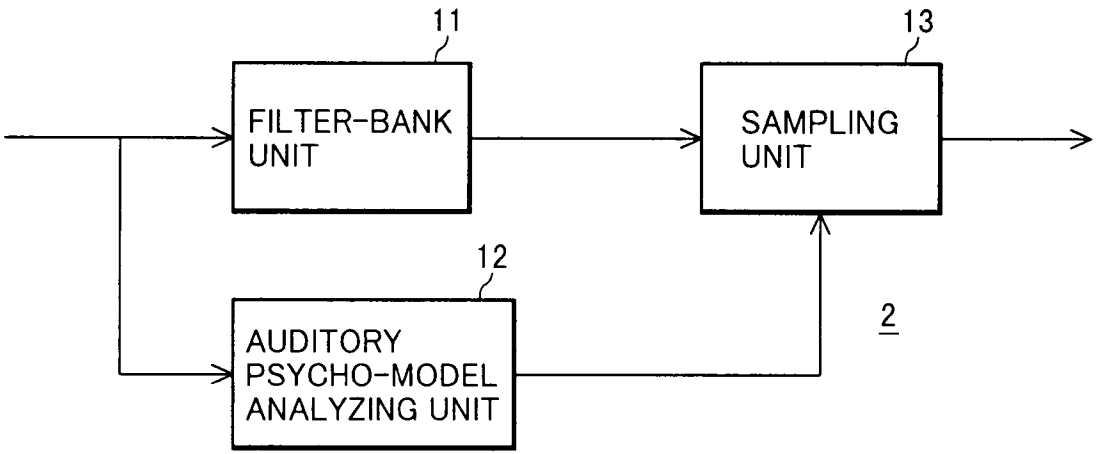

FIGS. 1A and 1B are schematic block diagrams showing an MP3 encoding system 100 according to a first embodiment of the present invention. FIG. 1A is a whole block diagram, and FIG. 1B is a functional block diagram of a MP3 encoding unit 2. This MP3 encoding system 100 is a system for inputting PCM audio data, encodes it to MP3 format data, and outputs the encoded data. Plurality of processors execute MP3 encoding by dividing the audio data for one piece of music into two or more divided data. The term "plurality of processors" in this specification includes that two or more processors encode each divided data simultaneously in parallel and that one processor encodes each divided data at different occasions. The PCM audio data input from outside is input to a dividing unit 1. Here, the input PCM audio data is input to the dividing unit 1 from a storage media (HDD, CD, DVD and the like) faster than normal reproduction speed. The dividing unit 1 divides the input audio data into plurality of divided data. As described later, division of the audio data is executed according to frame size of the MP3 as a unit, and each divided data has overlapping sections where several frames are overlapped with those in previous and following divided data. Each divided data is separately inputted into a MP3 encoding unit 2. As described in the above, in this MP3 encoding unit 2, plurality of encoding unit may be prepared in parallel, and one encoding unit may process each divided data at different timings. The MP3 encoding unit 2 inputs the encoded MP3 data into an analyzing unit 3 and a combine unit 4.

The analyzing unit 3 analyzes the overlapping sections of each divided data encoded into MP3 and determines at which frames to combine previous/following divided data (combination frames). The combine unit 4 combines the previous/following divided data at the combination frames determined by the analyzing unit 3 and restores an original one audio data in the MP3 format.

In this functional block diagram, at least one encoder included in the MP3 encoding unit 2, distribution unit 1, the analyzing unit 3 and the combine unit 4 can be realized by one personal computer. Also, plurality of the encoders may make the processors execute parallel processes by equipping board equipped plurality of processors in the personal computers or by transmitting and receiving the divided data by connecting to plurality of the personal computers. Also, users may input or output the divided data manually to the plurality of personal computers.

FIG. 1B is a functional block diagram of each encoder of the MP3 encoding unit 2. Also, FIG. 2 are diagrams showing a data structure of the MP3 data.

Figure 2A:
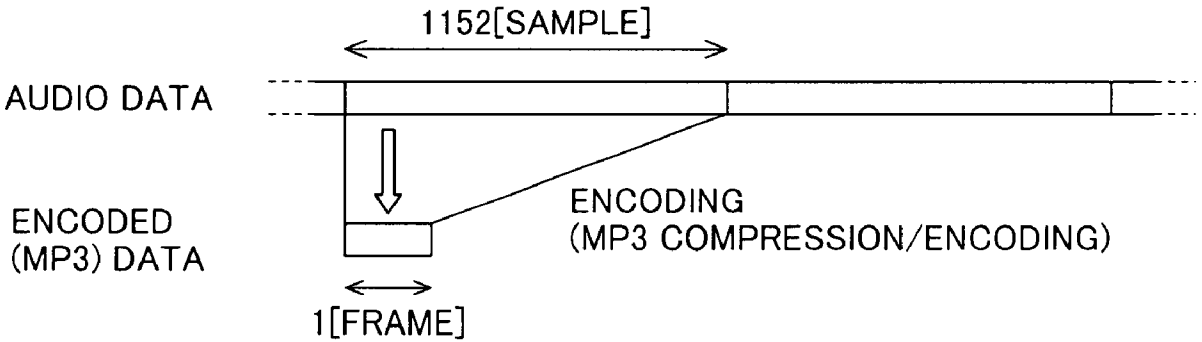
FIGS. 2A to 2C are diagrams showing a format of MP3 data.
Figure 2B:
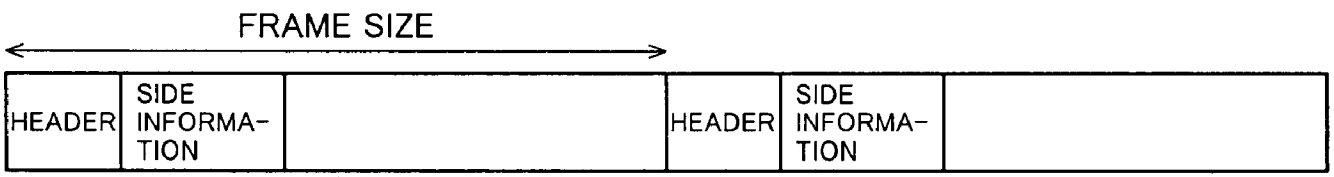
Figure 2C:
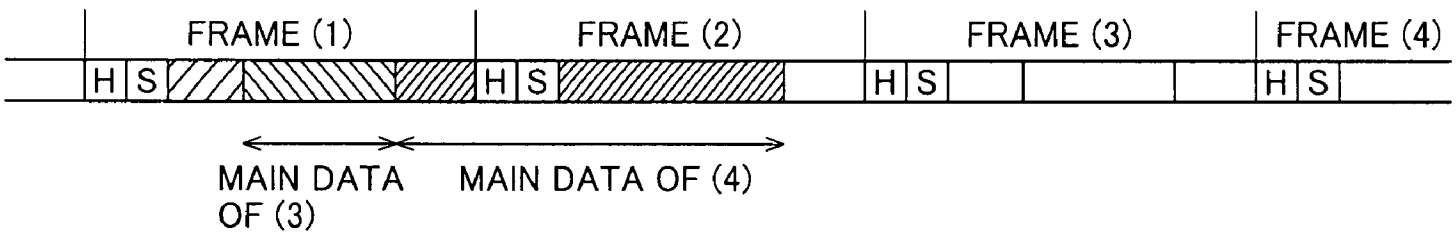

In FIGS. 2A to 2C, the MP3 data composes one frame with the 1152 samples of the PCM audio data. As shown in FIG. 2B, a structure of each frame is consisted of a header, side information, main data and the like. From the information in the header, i.e., sampling rate, bit rate and existence of padding, a frame size can be calculated. That is, a size of one frame (number of byte) is defined by 144*(bit rate)/(sampling rate). For example, when the bit rate is 128 kbps, and the sampling rate (sampling frequency fs) is 44.1 kHz;

$$144*128000/44100=417 \text{ byte}$$

However, below a decimal point is omitted, and in order to match the transmission bit rate as the whole MP3 data, a frame added (padding) 1 byte to one of several frames is constituted. That is the frame of 418 bytes (padding frame) is created by several frames.

Also, in the side information, data called "main data begin" is stored. This data is data indicating from where the sampling data unit (main data) of the above-described MP3 encoded 1152 samples begin. Here, although one frame of the MP3 format is targeted the 1152 samples as described in the above, it is permitted to distribute the sampling data unit (main data) of the 1152 samples over the main data area of plurality of adjoining frames other than one frame. That is, the data size at a time that the PCM data of the 1152 sampling data is encoded can be changed corresponding to a condition of the PCM data. By that, a data distribution (division) considering a sound quality can be executed by assigning a small amount of data in a section with simple sound and a large amount of the data in a section with a complex variation. Also, the difference of the data distribution amount by each frame generated at that time absorbs each main data size adjusted between plurality of adjoining frames to make it possible to distribute a large amount of data in a section having a large amount of the data. As a result, in a section having a small amount of the data, a blank is generated at the end part of the main data, and a space for distributing larger amount of data for a large amount of data after the following frame (bit storage).

Then, the main data of the following frame is not written from the main data area of the frame, but it begins to be written from the inside of the main data of the previous bit-stored frame. By that, it becomes unnecessary to change distribution bit rate. In addition to that, the area of the main data area of that part is saved. Then, since bit storage is carried out with other frames as described in the above, although the size of the encoded main data may be larger than the size of the main data of one frame, it can store in the amount of data corresponding to the amount of data of the main data area corresponding to the number of frames as a whole although such data is written in.

In FIG. 1B, the encoder of the MP3 encoding unit 2 is consisted of a filter-bank unit 11, an auditory psycho-model analyzing unit 12 and a sampling unit 13. The filter-bank unit 11 is consisted of a filter unit that divides the audio data into 32 frequency bands and a Modified Discrete Cosine Transform (MDCT) unit (not shown in the drawing), and converts the PCM audio data into 576 frequency resolution data. The auditory psycho-model analyzing unit 12 calculates a masking level (a hearing threshold level) from derive the pure sound component by 1024 points FFT (Fast Fourier Transform) analysis. The sampling unit 13 compresses the data length by the Huffman coding to the data from the filter-bank unit 11 based on the masking level calculated in the auditory psycho-model analyzing unit 12. By the above-described processes, when the audio data is encoded at bit rate of 128 kbps, the PCM audio data is compressed to MP3 data having a data size about 1/11 of the original audio data.

An example of bit storage is shown in FIG. 2C. This is the diagram showing the frame in the middle of music. The second half part of the main data of the frame (2), the main data of the frame (3) and the first half part of the main data of the frame (4) is written in the main data area of the frame (1). The remaining part of the main data of the frame (4) is written in the main data area of the frame (2). As described in the above, the main data is written over the frames; therefore, the main data is compressed to be bit-stored for the frame that can save the number of bits, and for the complex PCM data frame, the main data having a data size larger than the size of one frame can be written by using the stored bit. By doing that, high quality encoding becomes possible without increasing the overall amount of the data.

The filter-bank unit 11 executes the filtering process to the target frame and half portions of the adjoining frames. Therefore, when the data is divided, there is an influence of an existence of an adjoining frame near the divided point. Also, since the main data is moved according to the bit storage in the MP3 data, the recombined data will not be continuous when the divided data created by cutting the audio data on a time axis without making the overlapping sections are simply combined.

Then, the above-described distribution unit 1 creates the overlapping sections overlapping with the previous/following divided data when the audio data is divided into the divided data. Then, the analyzing unit 3 calculates an ideal combination frame, and the combine unit 4 combines the divided data at the combination frame calculated in the above with maintaining continuity of the main data. Operations of these function units are explained in detail in the following.

Figure 3:
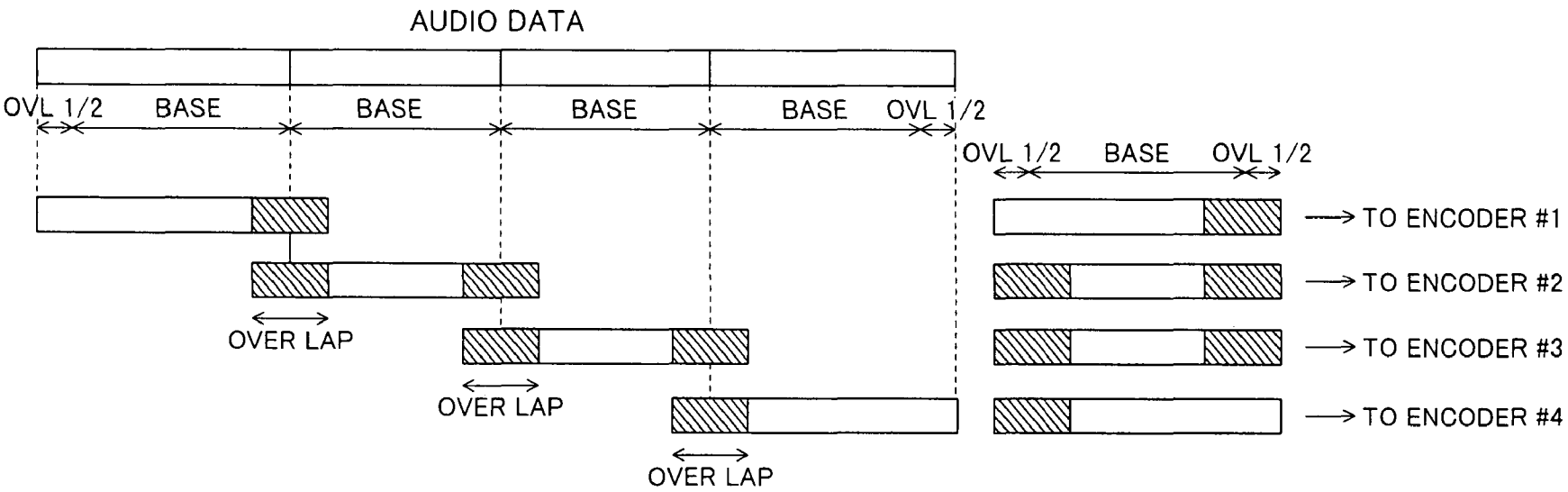
FIG. 3 is a diagram for explaining a process executed by the distributing unit 1 of the MP3 encoding system 100.

FIG. 3 is a diagram showing a dividing process of the PCM audio data that is executed by the distribution unit 1. When the audio data is divided, each divided data is designed to be an integer multiple of the number of the samples (e.g., 1152 samples in this embodiment) of one frame of the MP3 data. Moreover, the divided data is created to have the overlapping sections where the several frames are overlapped with those in the previous and the following frames. The number of frames of the overlapping sections is defined as the number of frames adding the number of frames for searching the frame that fits with the bit storage and the number of frames that can cover an adjoining frame required in the above-described filtering process.

In the drawing, the audio data for one piece of the music divided into four data, and each divided data is adjusted to be the same length. For that, the length of each divided data (number of the frames) is a number of frames represented by (base+ovl). Moreover, the basic divided number of frame "base" can be calculated by an equation: (size−ovl)/N, where the total number of data frame is "size", the dividing number "N" and the number of overlapping frame is "ovl". Therefore, since only one of the first divided data and the last divided data is overlapped with the adjoining divided data, a section not overlapped is (ovl)/2 longer than the divided data having two overlapping sections, that is, the divided data for the middle of the audio data. Moreover, when the data length (the number of samples) of the original PCM audio data is not the integer multiple of the number of samples of one frame of the MP3 data (1152 samples), the last one frame becomes a short frame. Also, when the number of frames of the PCM audio data is not a number which can be divided by the number N of division, the last (the Nth) divided data becomes divided data shorter than other divided data. Each divided data divided as described in the above is encoded into the MP3 data by the MP3 encoding unit 2, respectively.

Figure 4A:
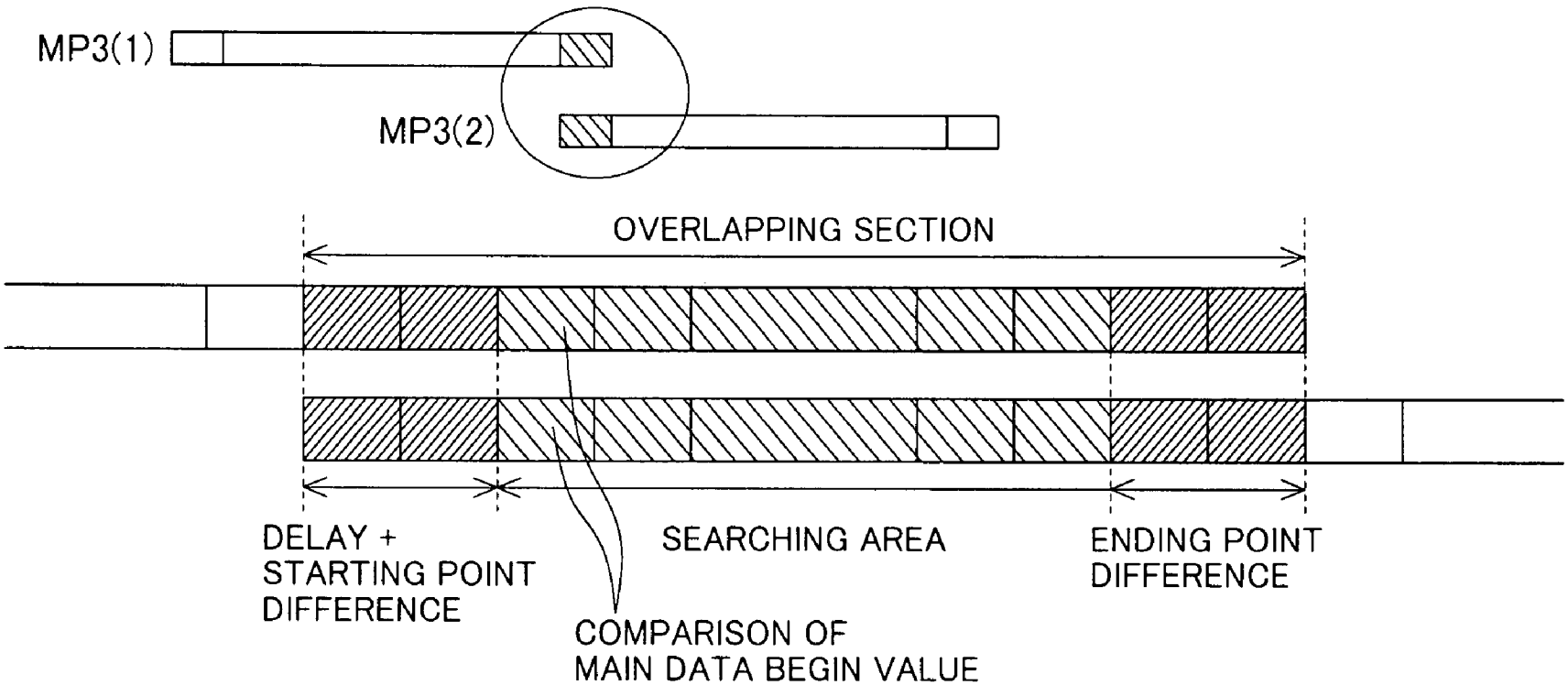
FIGS. 4A and 4B are diagrams for explaining a process executed by the analyzing unit 3 of the MP3 encoding system 100.
Figure 4B:
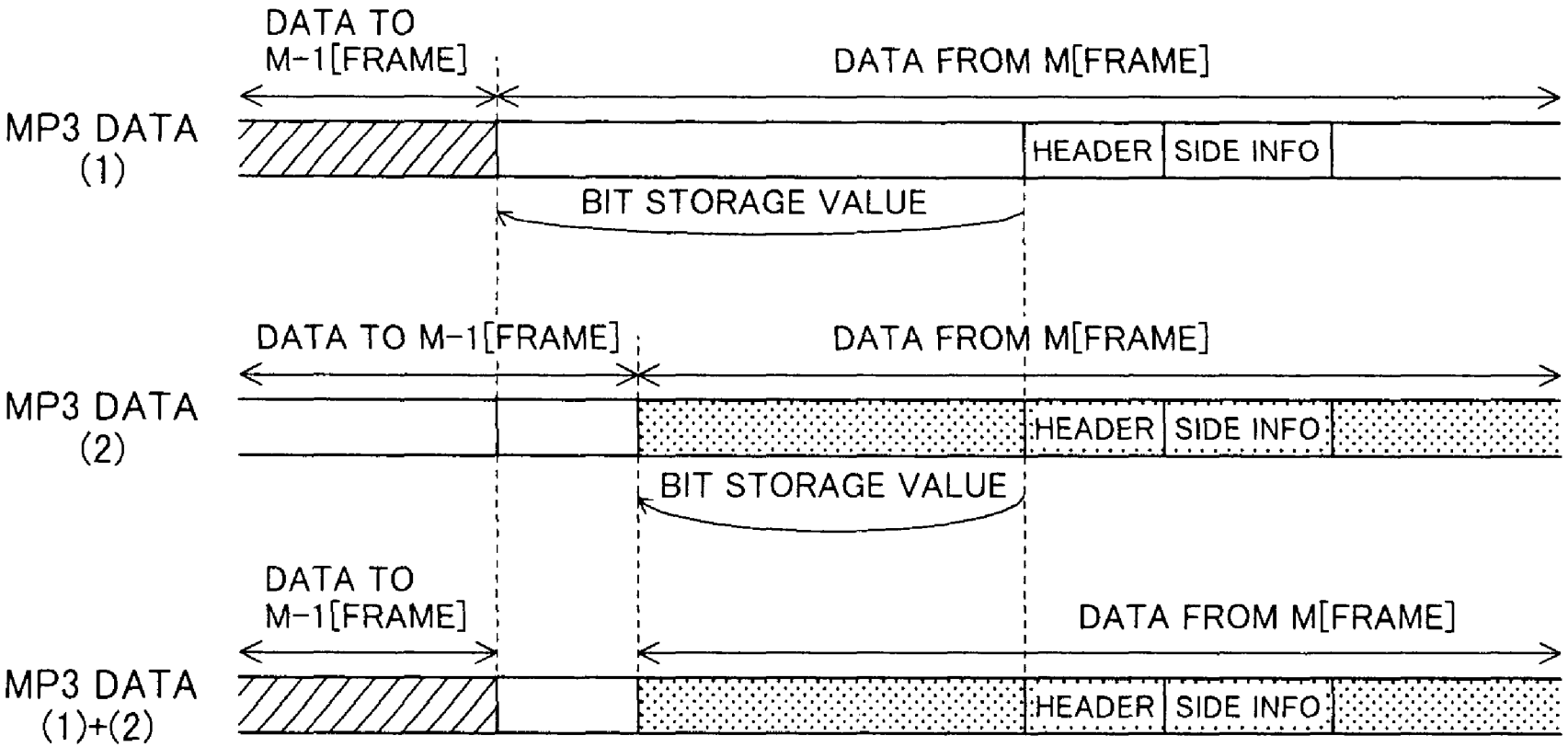
Figure 5:
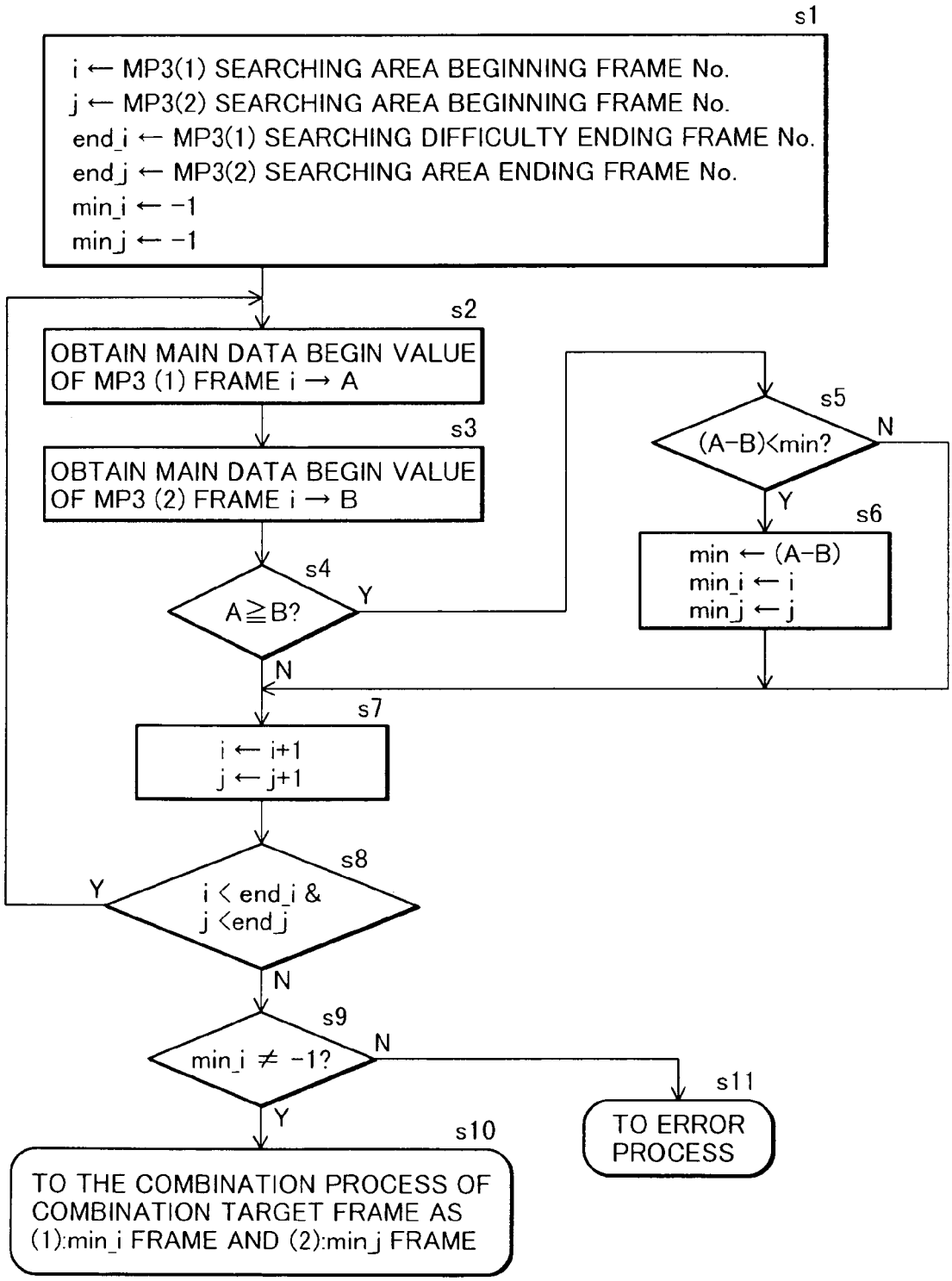
FIG. 5 is a flowchart showing the process executed by the analyzing unit 3 of the MP3 encoding system 100.

FIGS. 4 and FIG. 5 are diagrams explaining a combination frame searching process executed by the above-described analyzing unit 3. FIG. 4A explains a case for combining the divided data MP3(1) with the divided data MP3(2). The last two frames of the overlapping section of the divided data MP3(1) are abandoned as dummy frames to maintain the qualities of the previous frames because the last two frames are influenced by the ending point difference. Similar to that, the first two frames of the overlapping section of the divided data MP3(2) are abandoned as dummy frames to maintain the qualities of the following frames because the first two frames are influenced by filtering delay and the starting point difference. Therefore, since either one of center frames except two both sides frames in the overlapping section is defined as the combination frame, Conformity of the main data begin (bit storage value) of each frame corresponding to the divided data MP3(1) and the divided data MP3(2) in this section is checked.

That is, as shown in FIG. 4B, when the main data begin of the divided data MP3(1), the previous data, is placed at the same point as the main data begin of the divided data MP3(2), the following data, or placed before the following data, the main data of the divided data MP3(1) and the main data of the divided data MP3(2) can be combined without overlapping.

Moreover, when the data distribution is adjusted among the plurality of the adjoining frames in accordance with the bit storage, distribution amount is determined by the hearing information amount of the PCM data to be encoded and the bit storage value at that time. By that, although the same MP3 encoder as shown in FIG.1 is used and the PCM audio data having the same overlapping sections is encoded, bit storage values of the data encoded from the starting point of the overlapping section (MP3(2)) and of the data encoded before the starting point of the overlapping section (MP3(1)) become different from each other because the encoding process before the encoding process for the overlapping section is different form each other. Therefore, main data begin of whole area except both sides in the overlapping section shown in FIG. 4A are compared, frames near the main data begin of the MP3(1) and the main data begin of the MP3(2) in a range where the main data are not overlapped with each other are searched to be the combination frames.

When both divided data are combined at frames near the main data begin of the MP3(1) and the main data begin of the MP3(2) in the range where the main data are not overlapped with each other, the margin (blank area) of the main data after the combination shown in the lower part of FIG. 4B will decrease, and therefore the dummy data for filling up the blank can be decreased, and the main data area can be used efficiently.

FIG. 5 is a flowchart showing the process (combination frame searching process) of the analyzing unit 3. First, the searching area and register are reset at Step s1. The first frame numbers of searching area excepting both sides of the data in the overlapping sections of the MP3 (1) and the MP3 (2) are set to be "i" and "j" respectively. Then, the last frame numbers of searching area are set to be "end_i" and "end_j". Also, "−1" as a dummy data is set to the registers "min_i" and "min_j", each of which stores the frame number where the difference of main data begin of both data is minimum.

In the following, the main data begin of both data are compared from the first frames of the searching area to the last frames. The main data begin of the frame i of the divided data MP3 (1) is read out and written in the register A (Step s2), and the main data begin of the frame j of the divided data MP3 (2) is read out and written in the register B (Step s3). As a result of comparing these registers A and B, when a combination condition (A>=B) is satisfied (Step s4) and the difference (A−B) is the smallest among the frames compared before (Step s5), the difference (A−B) is written in a min register to make them the combination frames and the frame numbers i and j are written in "min_i" and "min_j" (Step s6). It is repeatedly performed until it processes the last frames "end_i" and "end_j" (Step s8) with incrementing "i" and "j" by "1", i.e., adding "1" every time (Step s7).

After executing the above-described processes for all the frames, "min_i" and "min_j" are determined as the combination frames and the determined combination frames are notified to the combine unit, and the process advances to the combination process (Step s10). At this time, when the frame number "min_i" is still the dummy data (−1), it is defined that there is no frame to satisfy the condition "A≧B"; therefore, the process doe not advance to the combination process but to an error process (Step s11).

Figure 6:
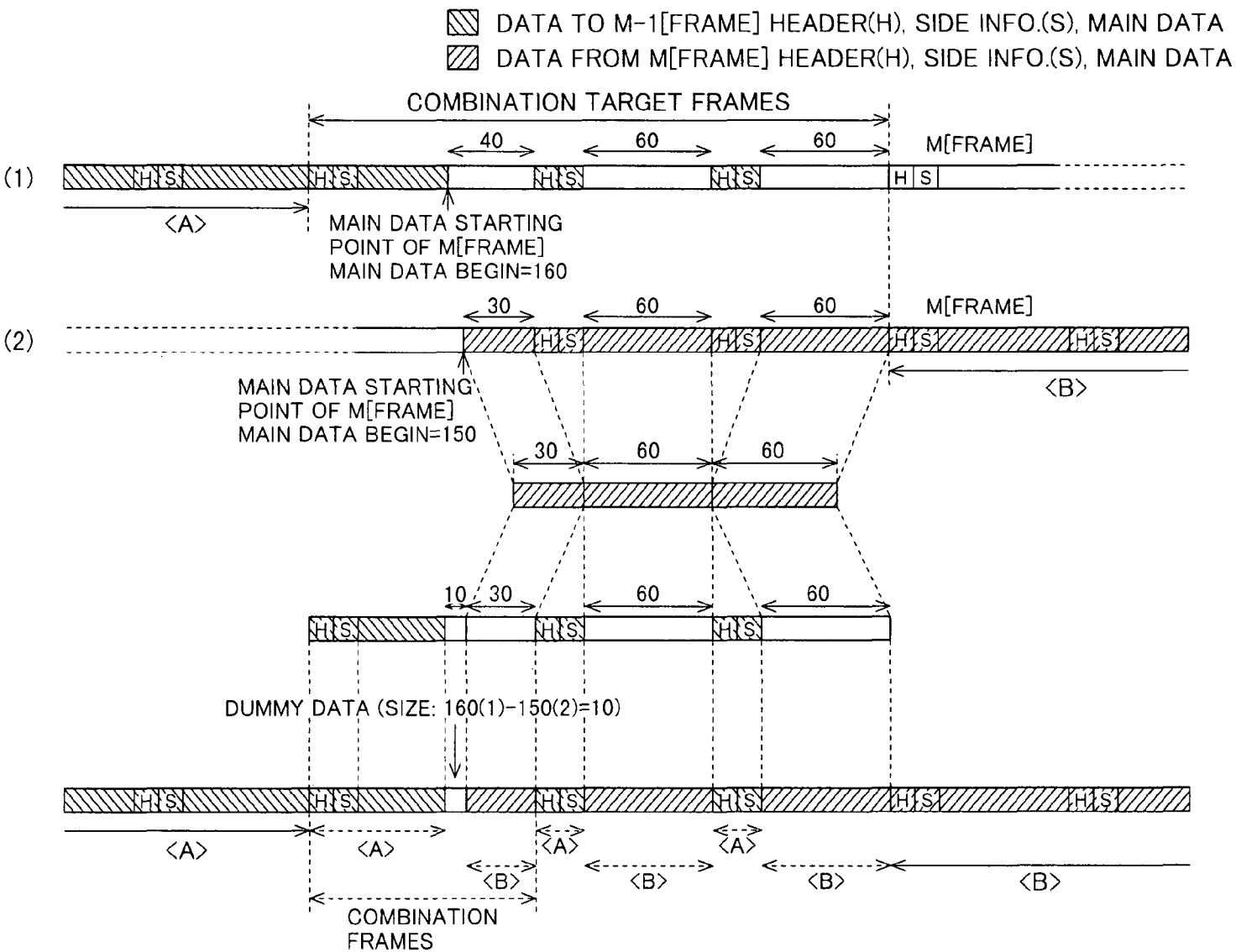
FIG. 6 is a diagram for explaining a process executed by the combine unit 4 of the MP3 encoding system 100.

FIG. 6 is a diagram for explaining a process executed by the combine unit 4 of the MP3 encoding system 100. The combine unit 4 combines the divided data MP3 (1) and the divided data MP3 (2) at the combination frames determined by the analyzing unit 3 in the above-described process. In the drawing, the case that the main data begin (bit storage value) of the combination frame "min_i" of the MP3 (1) is 160 and that the main data begin (bit storage value) of the combination frame "min_j" of the MP3 (2) is 150 is shown.

First, in the divided data MP3 (2), the main data of 150 samples, which are placed before the combination frame "min_j", is read out and stored. Next, in the divided data MP3 (1), from the frame containing the main data begin of the combination frame "min_i" to a frame (min_i−1z) just before the combination frame are defined as combination target frames. In the combination target frames, the main data of the divided data MP3 (1) is used as a header, side information, a frame size and main data before the main data begin of the combination frame "min_i". Then, after inserting the above-described dummy data with the size of (A−B=min) after the main data, the main data of the divided data MP3 (2) after the stored combination frame "min_j" is written in the main data area of the MP3 (1).

Then, for the frames after the above-described combination target frame (including combination frame "min_j"), the main data of the divided data MP3(2) is used for the combination, and for the frames before the combination target frame, the main data of the divided data MP3(1) is used for the combination.

As described in the above, according to the first embodiment of the present invention, the divided data are encoded separately, and thereafter the combination process is executed for obtaining the encoded data for one piece of the music. In terms of the frame flow of the data process, as obviously from FIG. 6, the process is considered as a changing process for the divided data MP3(1) and the divided data MP3(2).

Moreover, in the first embodiment of the present invention, the process when the PCM audio data is encoded into the MP3 data has been explained, other format that needs the data before or after the data of encoding point at the time of encoding can be adopted.

Figure 7:
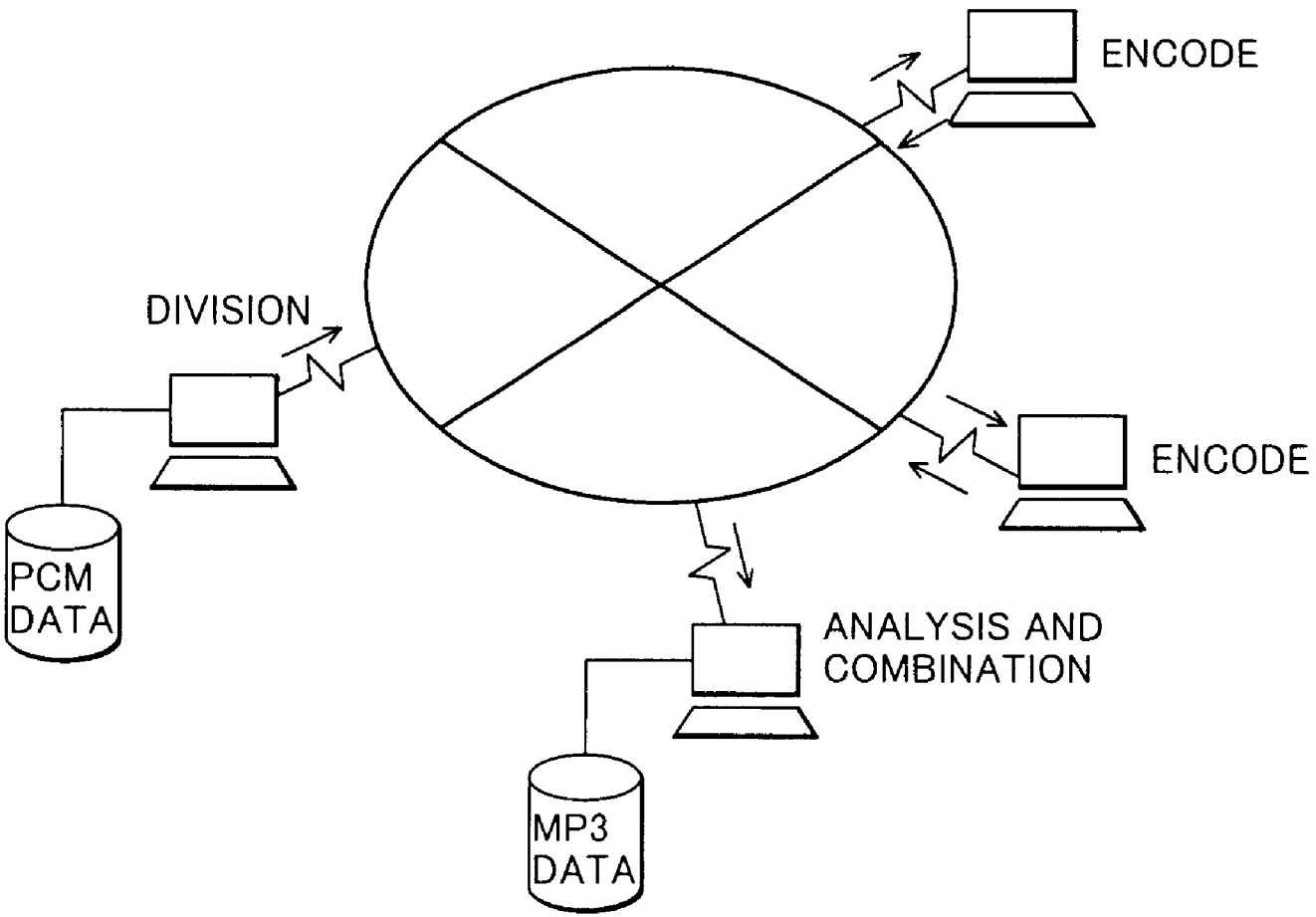
FIG. 7 is a diagram showing an example of a distributed process on a communication network of the MP3 encoding system 100.

Also, processes of division, analysis and combination according to the above-described first embodiment are executed by one personal computer to be a host. As shown in FIG. 7, plurality of personal computers are connected with the LAN or the WAN, the data division, the MP3 encoding, the analysis and the combination may be executed by a distribution process in a plurality of personal computers. Also, a server for distributing the separately encoded MP3 data (divided data) may be provided on the Internet, and the separately encoded MP3 data may be received, analyzed and combined at the terminal side.

Figure 8:
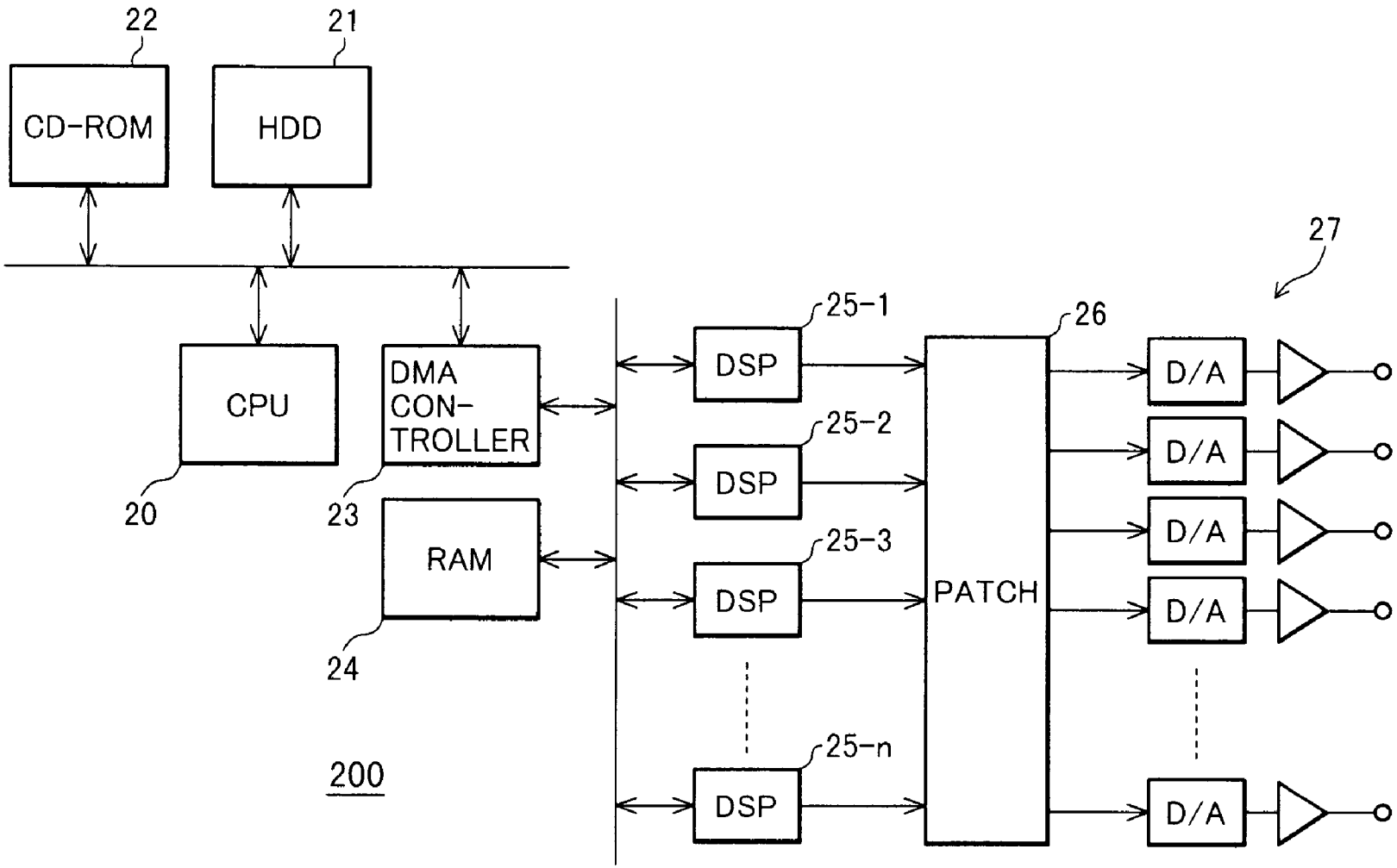
FIG. 8 is a block diagram showing a structure of an audio server 200 according to a second embodiment of the present invention.

FIG. 8 is a block diagram showing a structure of an audio server 200 according to a second embodiment of the present invention.

The audio server 200 is a device for providing audio signals as a group based on a reproducing request from a plurality of client devices (not shown in the drawing) respectively set-up in other places, and distributes music requested by each client device to each client device individually. Each client device is a device that equips with a request function to the audio server 200 and a reproduction function of analogue audio signals.

When the music is requested from the client device, the audio server 200 reads out the requested MP3 data from the HDD 21. Then, the audio server 200 decodes the MP3 data with a DSP 25 that is a processor and converts the MP3 data to the analogue signals by an analogue circuit 27 to distribute the client device requesting the reproduction.

In order to correspond to the request from plurality of the client devices, the plurality of the DSPs 25 are provided. The number of the DSP 25 (n) is less than the number of the client devices considering availability of each client device. On the other hand, the number of the analogue circuits 27, each including a DA converter and an amplifier is same as the number of the client devices, and each corresponds to each client device 1 by 1. These plurality of the DSPs 25 are connected with the analogue circuits 27 by a patch bay 16. The patch bay 16 connects the analogue circuit 27 connected with the requesting client device and with the DSP 25 that decodes the MP3 data of the requested music.

A CPU 20 that controls the audio server 200 receives the request from each client device by a communication function (not shown in the drawing). When the CPU 20 receives the request, it assigns one of the DSPs 25 (25-1~25-n) as the DSP to decode the requested musical data (MP3 data), and controls the patch bay 16 in order to connect this DSP with the analogue circuit 27 of the requesting client device.

In order to correspond to the request from the client device, plurality of the MP3 data are stored in the HDD 21. This audio server 200 reads the PCM audio data from an audio CD set in a CD-ROM 22 and encodes it to the MP3 data. Then, the audio server 200 stores this encoded MP3 data in the HDD 21. This encoding process is executed by the above-described DSPs 25 (25-1~n). That is, when there is a free DSP that is not executing the decoding process of the MP3 data in the DSPs 25 (25-1~n), the above-described PCM audio data is encoded to the MP3 data by using the free time of the DSP.

In order to manage a status (operating condition) of each DSP of the DSPs 25-1~n, a processor management table is set on the HDD 21. The CPU 20 detects the operating condition of each DSP, and either one status information of "other processing", "encode processing" and "free (blank)" is written in the processor management table. "Other processing" indicates that the decoding process of the MP3 data is in progress, "encode processing" indicates the encoding process of the PCM audio data is in progress, and "free" indicates that free is currently in progress and waiting for an operation instruction.

Also, it takes a certain time for the DSP to encode the PCM audio data for one piece of the music. When the reproduction of music (decoding of the MP3 data) is requested during the encoding process, if the request is held to wait until the encoding process is finished, a waiting time of the client device will be long and will cause decline of availability of the client device. Therefore, it may cause the degradation in the service to customers. Then, in this audio server 200, the PCM audio data for one piece of the music is divided into the plurality of divided data, and individual encoding process is executed by each divided data. By shortening process time by decreasing processing amount for one process, waiting time of the request can be shortened even if the request is received during all the DSPs are executing processes and there is no "free" DSP.

When the musical data is divided into the plurality of the divided data, a divided data management table is formed on the HDD 21, and for each divided data, a position, a size, a status representing whether the encoding process is executed to that divided data or not are stored. In the divided data management table, a record is formed for each divided data. In each record, the first frame number of the divided data, size (the number of the frames) and status data are included. The first frame number is a sequence number representing a sequential position of the first frame of this divided data, and the position of the divided data can be detected by this information. The size is represented by the number of the frames. The status is information that represents the operation status of this divided data, and has three statuses: "unencoded", "encoding" and "encoded". "Unencoded" indicates a status that the encoding process has not performed to this divided data yet, "encoding" indicates a status that the MP3 encoding process to this divided data is currently in progress at the DSP, and "encoded" indicates a status that the encoding process to this divided data has already been finished.

The CPU 20 divides the musical data (the PCM audio data) into the plurality of the divided data and recombines the plurality of the divided data encoded into the MP3 data in order to form the MP3 data for one piece of the music. The MP3 data formed into one piece of music is stored in the HDD 21 as data to be reproduced corresponding the request.

Moreover, the methods of the division and the combination of the PCM audio data and the MP3 data are almost the same as the above-described first embodiment. That is, the division of audio data is performed with a consideration of the frame size of the MP3 data as a unit, and at least one overlapping section where the previous/following data is overlapped with the data of the current frame along the several frames is created in each divided data. Each MP3 encoded divided data encoded is determined at which frame to be combined with the previous/following divided data by analyzing the overlapping section. By combining the previous/following divided data sequentially with the determined combination frame, the audio data for an original piece of the music is restored with the format encoded into the MP3.

Figure 9A:
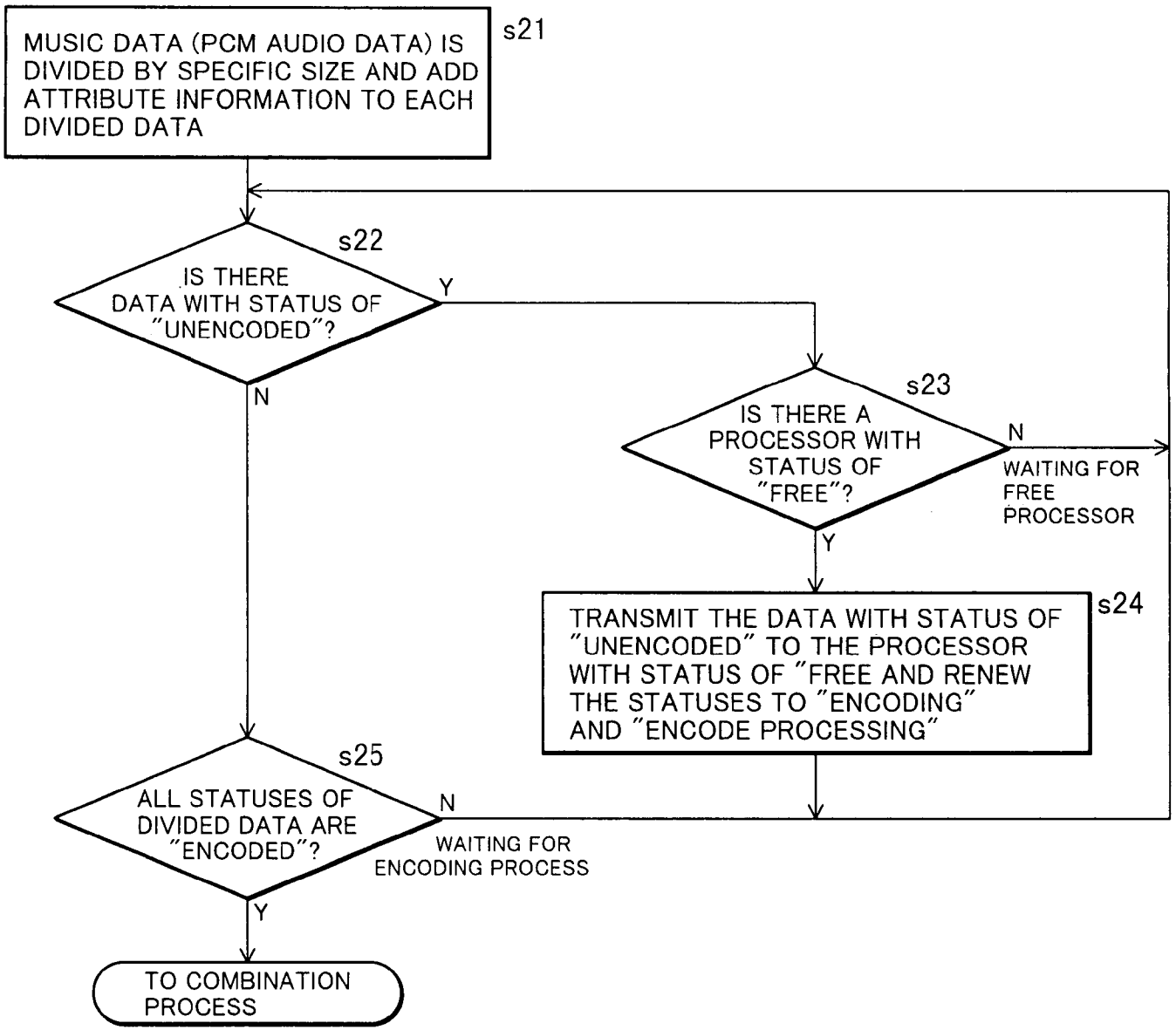
FIGS. 9A and 9B are flowcharts showing a divided data management process executed by the CPU and the DSP.
Figure 9B:
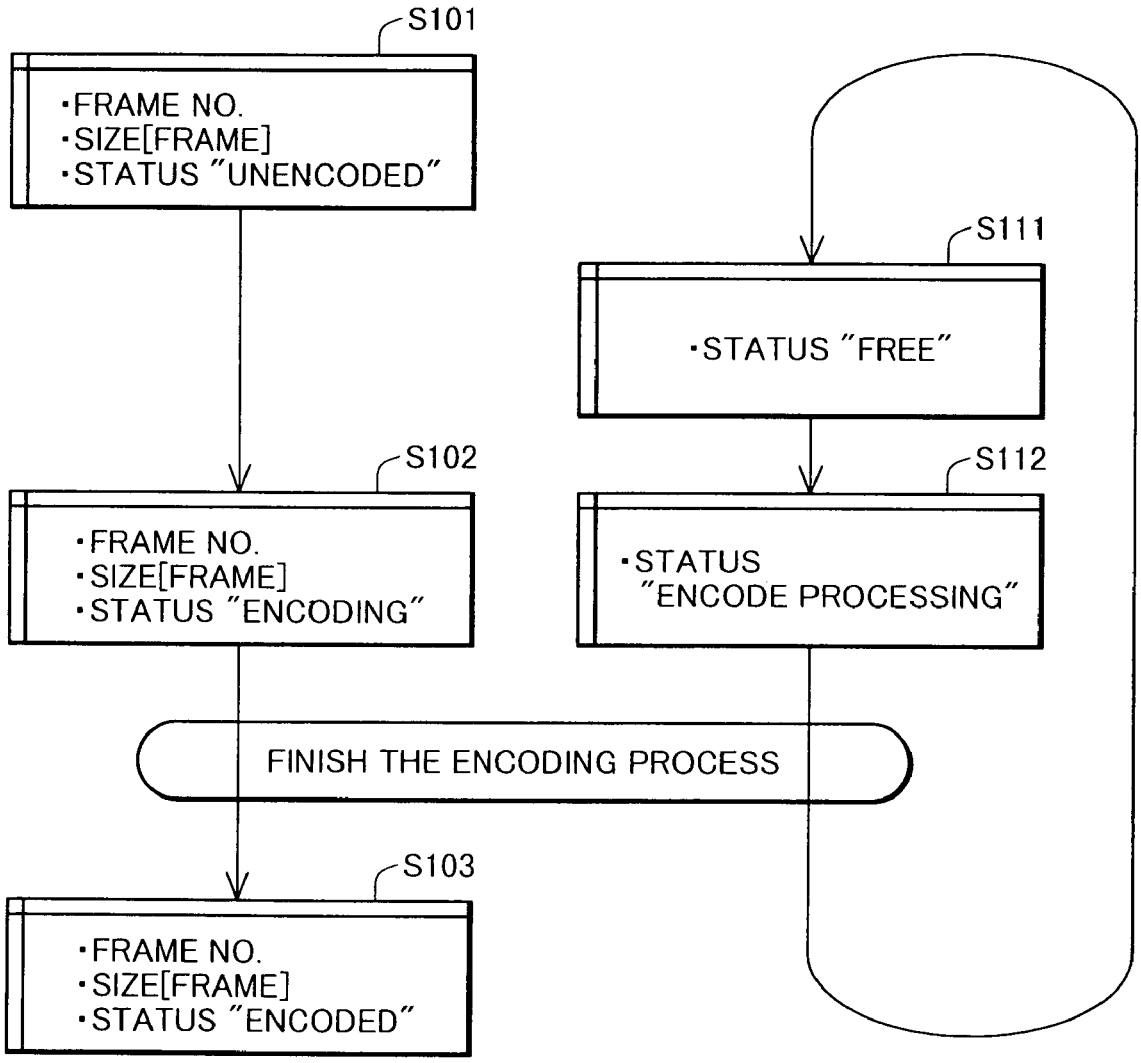

FIG. 9A is a flowchart showing an operation of the CPU 20 managing the plurality of the divided data and the processors (DSP 25-1 to 25-n). FIG. 9B is a diagram for explaining renewals of the divided data managing table and the processor managing table.

As shown in FIG. 9A, when the music data (PCM audio data) is read, the divided data are created by cutting the PCM audio data by a specific size as shown in FIG. 3 and are stored in the HDD 21 (Step s21). Attribute information is added to each divided data, and the divided data management table corresponding to the music data is created. In this divided data management table, a record represented by S101 shown in FIG. 9B is set to each divided data. When the divided data is derived from the music data at Step s21, statuses for all the divided data are "unencoded".

Processes at Step s23 and Step s24 are repeated after the division of the music data until Step s22 judges there is no data with the statuses "unencoded". At Step s23, it is judged whether there is a DSP with a status "free" in the DSP 25-1 to 25-n or not. When there is no DSP with the status "free", the process will wait for appearing the DSP with the status "free", with repeating the processes at Step s23 and Step s24. When there is a DSP with the status "free", the flow advances to Step s24, and the CPU 20 makes the DSP with the status "free" execute encoding of the MP3 data by transmitting the divided data with the statuses "unencoded" (Step s24).

At the same time, the processor management table is updated by changing the status of the DSP to "encode processing" (refer to S112), and the divided data management table is updated by changing the status of the divided data to "encoding" (refer to S102).

The DSP returns the encoded MP3 data to the CPU 20 after finishing the encoding process of the divided data transmitted from the CPU 20. The CPU20 stores the MP3 encoded divided data into the HDD 21 and changes the status of the divided data in the divided data management table to "encoded" as represented by S103 and the status of the DSP to "free" in order to return the status to be the condition as represented by S111.

When Step s25 judges that the above-described process is executed to all the divided data and the statuses of all the divided data are changed from "unencoded" to "encoded", the process advances to the combination process shown in FIG. 4 to FIG. 6.

Although, in the process shown in FIG. 9A, while the processor with the status of "free" is encoding the divided data, the decoding process (other process) corresponding to the request cannot be executed until the status of this processor or other processor turns to be "free" even if the request for the decoding process (other process) is received from the client device, the decoding process may have priority over the encoding process, that is, the decoding process corresponding to the request may be executed by terminating the process of the processor executing the encoding process when the DSP with the status of "free" cannot be found.

That type of the process is shown in FIGS. 10. In these drawings, when the request for other process is received during the encoding of the divided data, the encoding of the divided data is terminated in the middle, and the divided data is further divided at the terminated point into an encoded part and a non-encoded part. The both parts are returned to the CPU 20. The CPU 20 treats the non-encoded part as the divided data with the status of "unencoded" and the encoded part as the divided data with the status of "encoded".

Figure 10A:
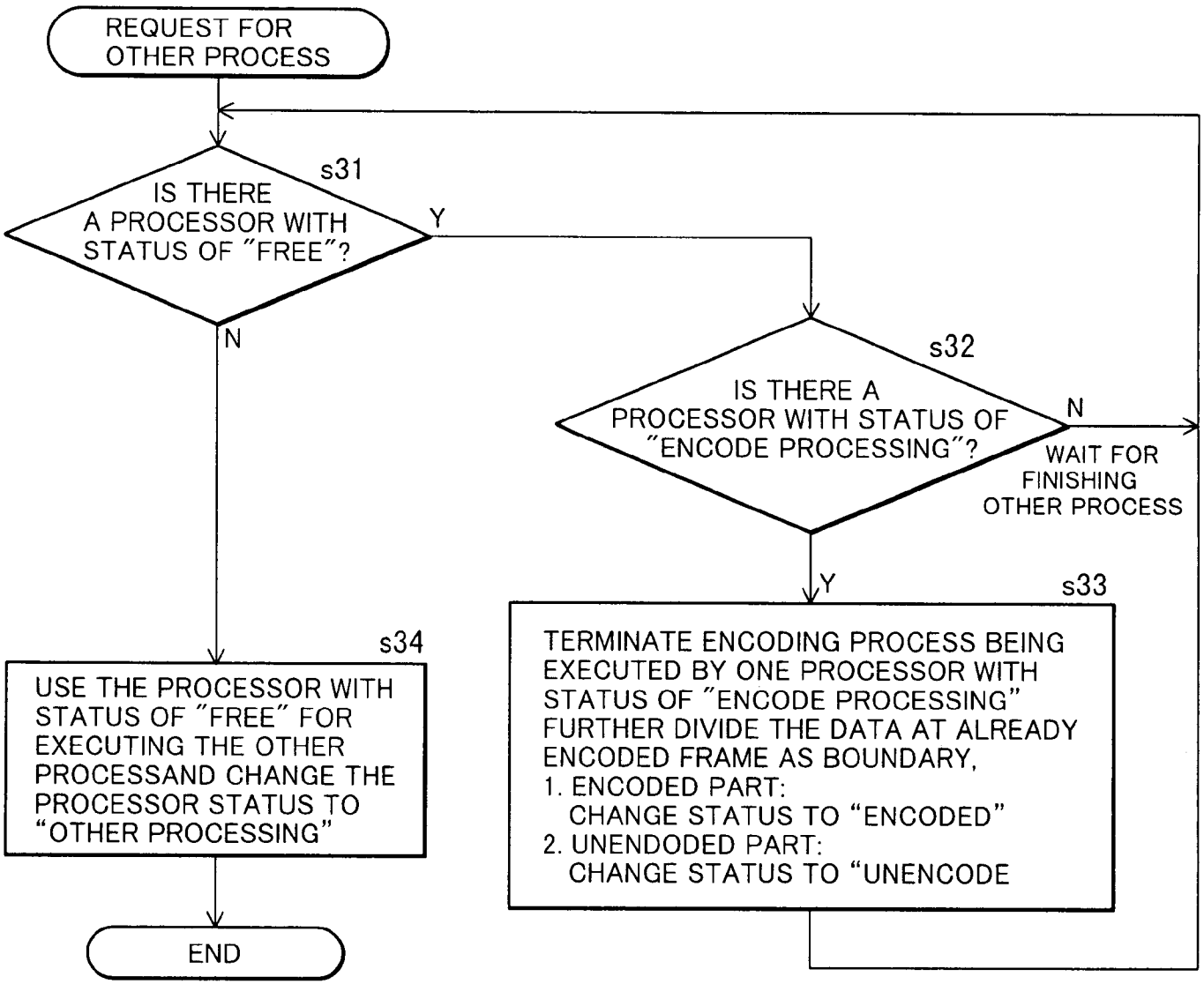
FIGS. 10A to 10C are flowcharts showing a divided data management process executed by the CPU and the DSP.

FIG. 10A is a flowchart showing an operation when the request for other process is received from the client device. When the request for other process is received, a DSP with the status of "free" is searched from the processor management table (Step s31). When the DSP with the status of "free" is detected, the other process corresponding to the request is assigned to the detected DSP with the status of "free" (Step s34) because it is not necessary to terminate the operations of the other DSPs, and the status of the detected processor is changed to "other processing".

On the other hand, when the DSP with the status of "free" is not detected, a DSP currently encoding the divided data into the MP3 data, that is, a DSP with the status of "encode processing" is searched. When the DSP with the status of "encode processing" is not detected, the process will wait at Step s31 until the status of either one of the processors turns to be "free" after the processor finishes the other process.

When the DSP with the status of "encode processing" is detected, the encoding process (when the DSP is processing the plurality of encoding processes, one the encoding process) is terminated, and the encoding divided data is recovered from the DSP. Then, as shown in FIG. 10C, the divided data is further divided at the terminating point. After this re-division, the un-processed part of the divided data will be treated as the new divided data.

Figure 10B:
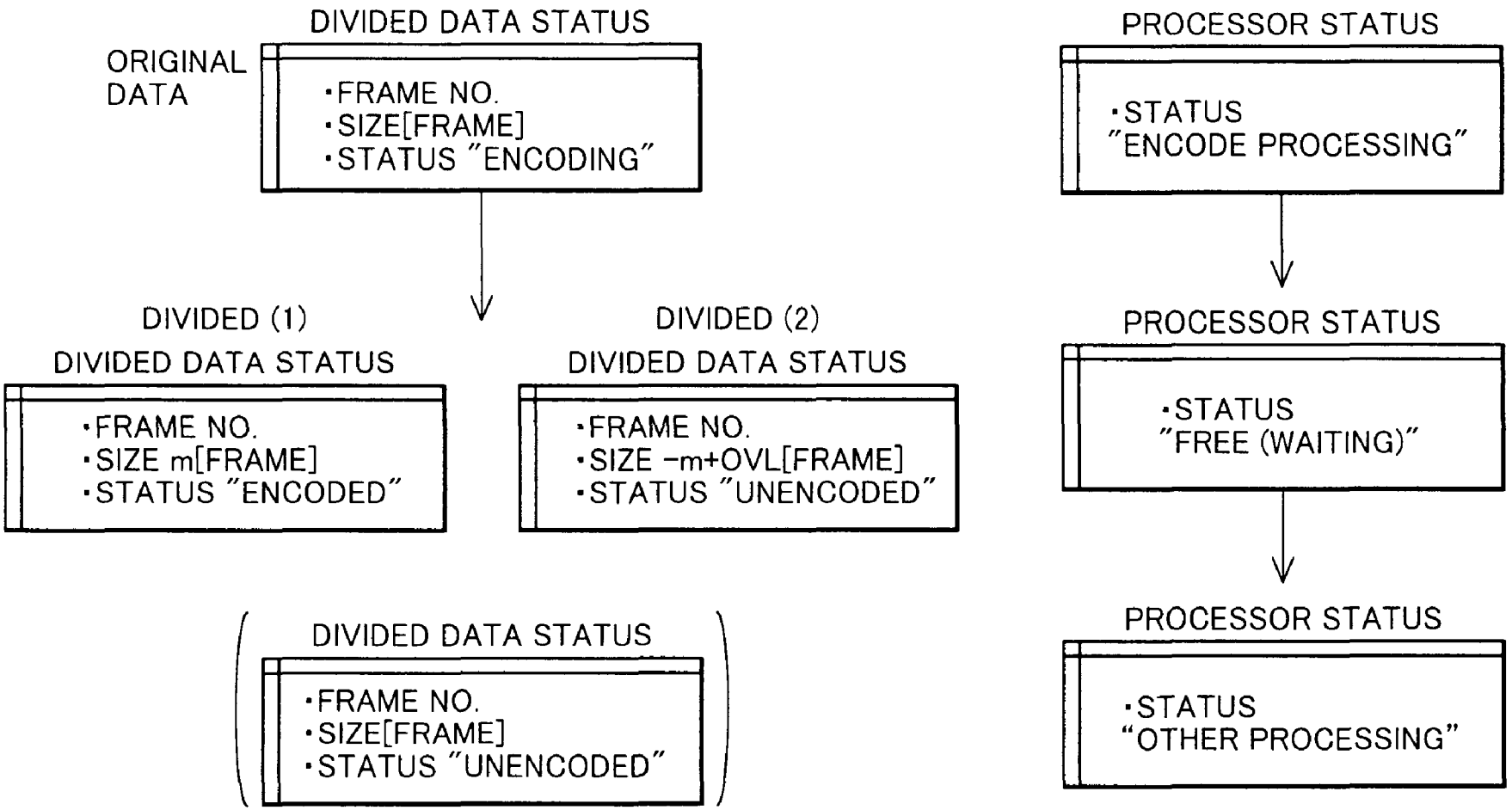
Figure 10C:
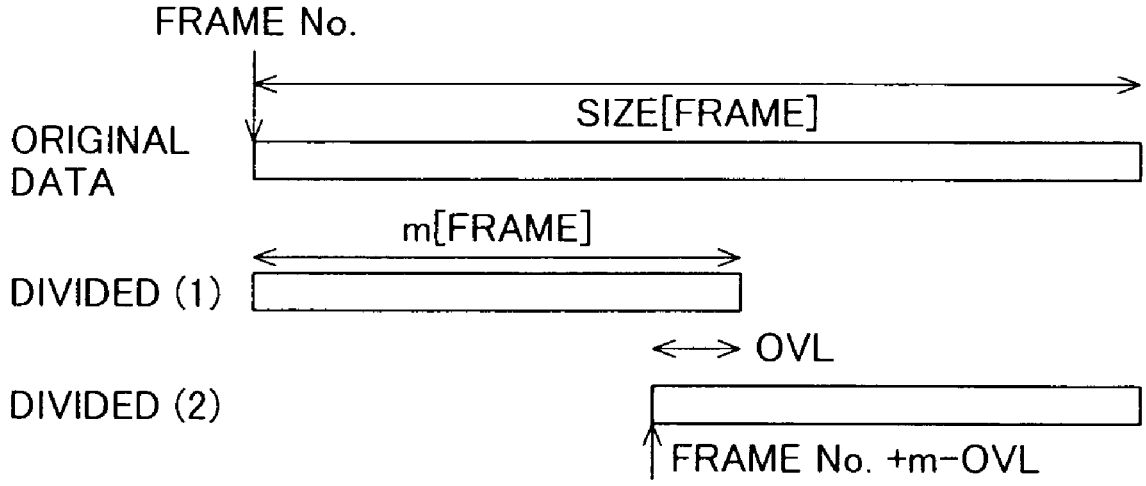

Then, as shown in FIG. 10B, the content of the divided data management table is updated. The data that is already encoded is temporally stored in the HDD 21 as the divided data with the status of "encoded", and the record of the original divided data in the divided data management table is updated. That is, the size is changed to the already encoded number of frames m, and the status is change to "encoded". Then, the new divided data is created in the HDD 21, and a record including information: the first frame number is "start frame number of the original data (frame NO)+m−ovl"; the size is "original data size (size)−m+ovl"; and the status is "unencoded", is created as a record for the new divided data in the divided data management table.

When the number of frames of the encoded data is smaller than the number of the overlapping frames (ovl), the above-described dividing process is not executed because it is not efficient. Therefore, the encoded data is abandoned.

Thereafter, for the DSP terminating the encoding process, the status is changed to "free", and the process advances to Step s34.

By that, the request from the client device can be executed with higher priority than the internal process, that is, the encoding process; therefore, the function of the audio server will not be lowered.

Figure 11:
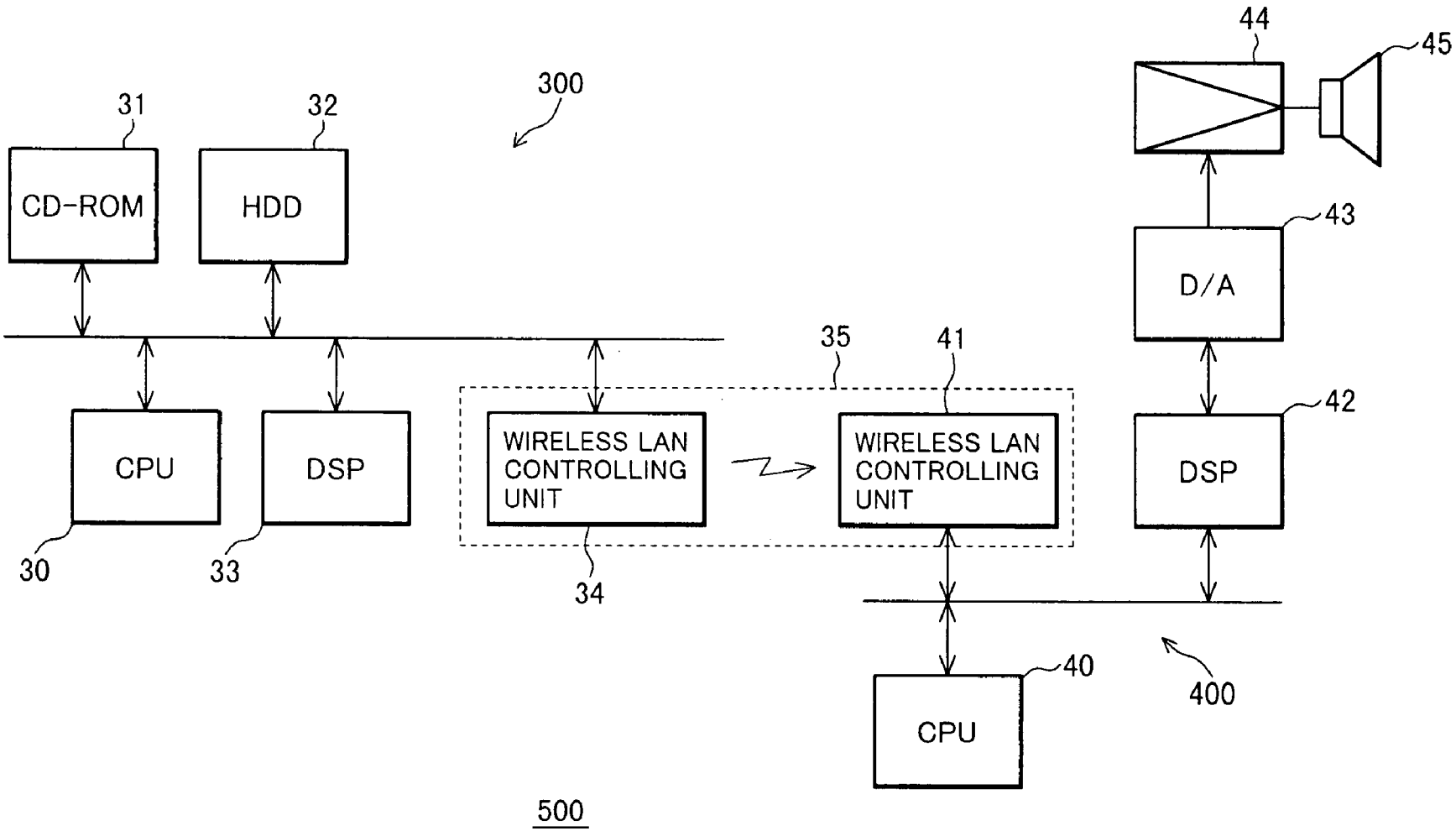
FIG. 11 is a block diagram showing an audio data distributing system 500 according to a third embodiment of the present invention.

FIG. 11 is a block diagram showing an audio data distributing system 500 according to a third embodiment of the present invention. The audio data distributing system 500 has an audio server 300 and a client device 400 connected to the audio server 300 via a wireless LAN 35.

The audio server 300 stores a plurality of music data (PCM audio data). The audio server 300 reads out the stored music data corresponding to a request from a client device 400, and steam-distributes the music data to the client device 400 via the wireless LAN 35 with encoding the music data from the PCM format to the MP3 format at real time.

The encoding of the PCM data to the MP3 data is not executed throughout a whole music data, but the encoding is executed to each divided data created by dividing the PCM data. The bit rate of encoding each divided data is determined just before the encoding in accordance with a condition of the wireless LAN 35. Therefore, the optimized bit rate corresponding to the current communication condition can be selected.

The encoding of the PCM data to the MP3 data is executed not only with reference to the target data (frame) but also to the previous and following data (frames); therefore, the divided data is created to have the overlapping sections where the previous and following data are overlapped with the data of the current frame in order to make the combined point of the data continuous, and the divided data are combined after being encoded to the MP3 data and transmitted to the client device 400.

As shown in FIG. 11, the audio server 300 has a CPU 30, a CD-ROM drive 31, a HDD 32, a DSP 33 and a wireless LAN controlling unit 34.

The CPU 30 is a controller that controls operations of the audio server 300 and executes processes for reading out the stored music data in accordance with a request from a client device 400, dividing the read-out data into the plurality of the divided data, encoding and recombining the divided data in the MP3 format, and streaming the music data to the client device 400 via the wireless LAN 35, etc.

The DSP 33 is a processor for encoding the PCM audio data supplied by the CPU 30 into the MP3 data. The PCM audio data is supplied as the plurality of the divided data, and the bit rate for encoding is defined for each divided data. Each divided data is encoded to the MP3 data at the defined bit rate.

The wireless LAN controlling unit 34 is a controller that can communicate on a wireless communication network by using a communication protocol such as the IEEE802.11b. The wireless LAN controlling unit 34 receives the request from the client device 400 and streams the audio data encoded to the MP3 data in accordance with the request. Moreover, the wireless LAN controlling unit 34 watches and detects the communication condition of the communication network.

The client device 400has a CPU 40, a wireless LAN controlling unit 41, a DSP 42, a DA converter 43, an amplifier 44 and a loudspeaker 45.

The CPU 40 is a controller of the client device 400. The CPU 40 transmits the request input by a user to the audio server 300 via the wireless LAN controlling unit 41 and inputs the MP3 data received via the wireless LAN controlling unit 41.

The wireless LAN controlling unit 41 communicates with the wireless controlling unit 34 of the audio server 300 by using a communication protocol such as the IEEE802.11b. The wireless LAN controlling unit 41 transmits the request and receives audio stream data of the encoded MP3 data.

The DSP 42 is a processor for decoding the received MP3 data to the PCM audio data. The bit rate of the received MP3 data is written in the side information for each frame, and the DSP 42 decodes the MP3 data to the PCM audio data in accordance with the bit rate written in the side information.

An analogue circuit unit is consisted of the DA converter 43, the amplifier 44 and the loudspeaker 45, converts the PCM audio data decoded by the DSP 42 into analogue audio signals and amplifies/outputs the signals.

Figure 12:
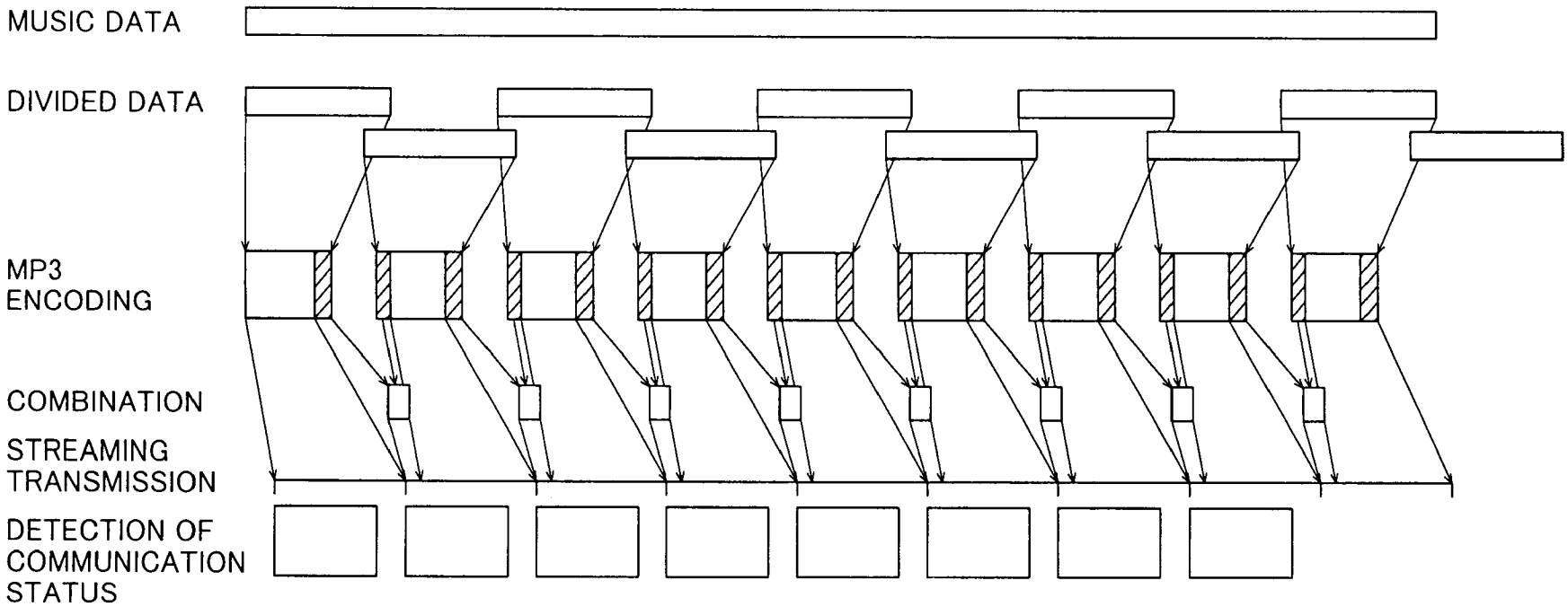
FIG. 12 is a diagram for explaining a procedure of encoding and distributing by the audio server 300.

FIG. 12 is a diagram for explaining a procedure of encoding and distributing by the audio server 300. In the audio data distributing system 500, the communication condition of the wireless LAN 35 is detected (watched) by the wireless LAN controlling unit 34, and the PCM audio data is encoded into the MP3 data at the bit rate selected in accordance with the detected condition.

The music data (PCM audio data) read-out in accordance with the request is lengthy as shown in the top of the drawing, and so the music data is divided into the plurality of the divided data. In the drawing, the PCM audio data is divided into nine divided data. Each divided data is created to have the overlapping sections where the data are overlapped with those of the previous and the following data.

Each divided data is separately and sequentially encoded into the MP3 data, and the MP3 data are combined and streamed to the client device 400. The combination of the divided data is executed at proper frames (combination frames) in the overlapping sections.

The CPU 30 inputs the MP3 data encoded by the DSP 33 sequentially form the beginning to the wireless LAN controlling unit 34. This wireless LAN controlling unit 34 streams the data to distribute and watches the condition of the wireless LAN.

The condition of the communication can be detected by the following ways. When the distribution is executed by using the TCP protocol, the condition can be detected by re-transmission frequency. When the communication network is a wireless LAN, the condition can be detected by intensity of the radio wave. Inn this case, the audio server 300 receives a control signal from the client device 400; therefore the condition can be detected in accordance with the intensity of the radio wave for the control signal. Also, the client device 400 may transmit another information representing communication quality to the audio server 300.

The bit rate for encoding the PCM audio data into the MP3 data is determined in accordance with the condition of the communication network. This bit rate is changed according to a unit of at he frame, and the bit rate for encoding is determined from the communication condition during the streaming of the previous frame.

Figure 13:
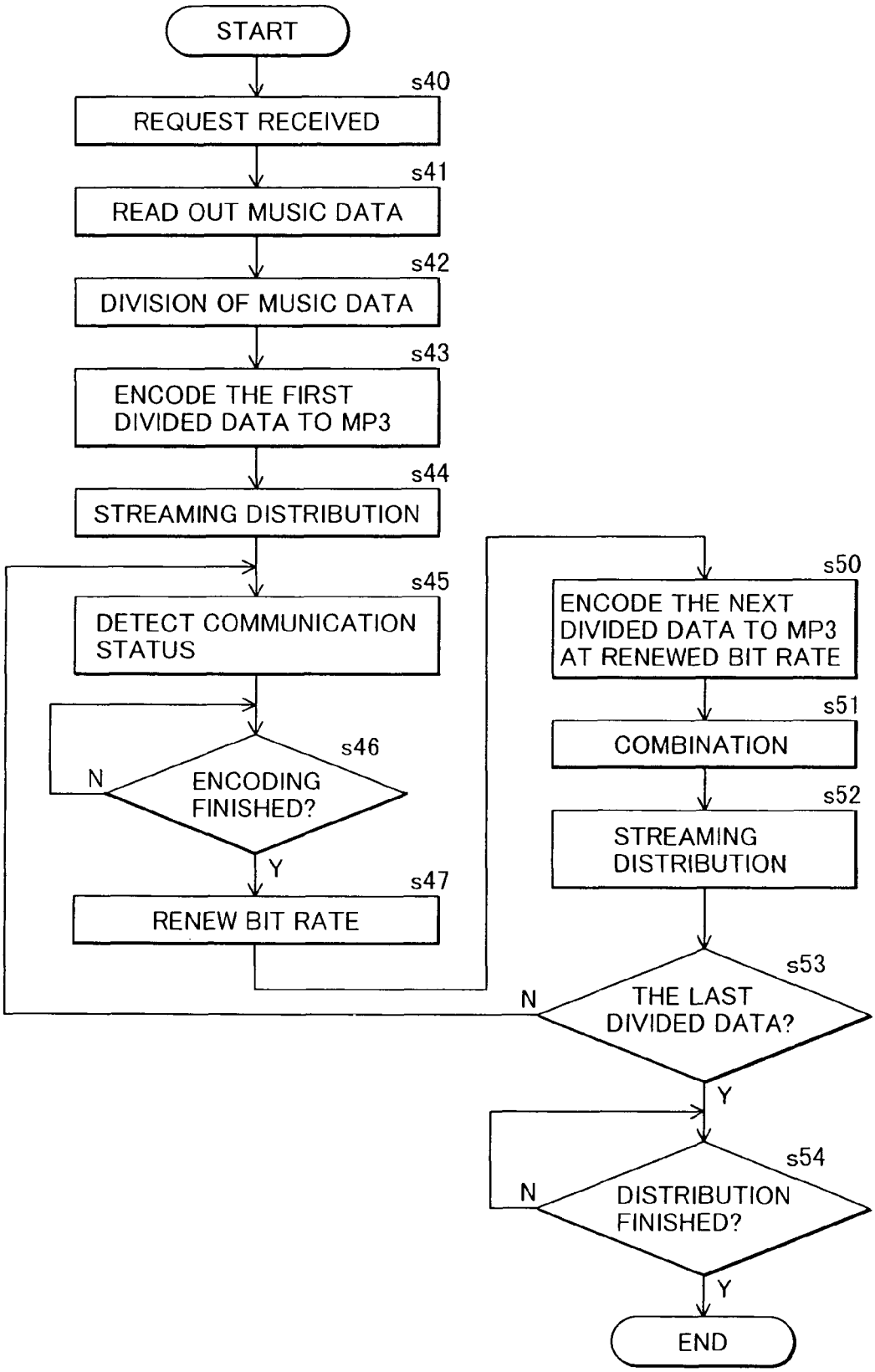
FIG. 13 is a flowchart showing a process executed by the audio server 300.

FIG. 13 is a flowchart showing a process executed by the audio server 300. When the request from the client device 400 is input (Step s40), the music data (PCM audio data) corresponding to the request is read-out from a CD-ROM or the HDD (Step s41). Then, the music data is divided into the plurality of the divided data (Step s42). Thereafter, the first divided data is encoded into the MP3 data at a default bit rate (Step s43), and the encoded data is distributed by streaming via the wireless LAN controlling unit 34 (Step s44). The communication condition of the wireless LAN 35 is watched (detected) in parallel to the streaming distribution (Step s45). The processes at Step s43, s44 and s45 are executed in parallel until the encoding process of the first divided data is finished. Then, after the encoding of the first divided data is finished (Step s46), the bit rate for the following divided data is selected in accordance with the communication condition of the streaming distribution of the first divided data detected at Step s45.

The encoding of the following divided data is started at the newly selected bit rate, and the previous divided data and the current encoding divided data are combined when the encoding of the overlapping section is finished (Step s51). The streaming distribution of the current encoding divided data is started to follow the previous streaming distribution of the previous divided data (Step s52). When the current encoding divided data is the last divided data (Step s53), this process is terminated after the completion of the encoding of this divided data (Step s54). When this divided data is not the last divided data, then the process advances to Step s45.

In the audio server 300 according to the third embodiment of the present invention, the PCM audio data is divided into the plurality of the divided data, and each divided data is encoded into the MP3 data at the bit rate suited for the condition of the communication network. Therefore, the audio data can be distributed with the best sound quality corresponding to the condition of the communication network without a lack of the sound.

When the PCM audio data is encoded into the MP3 data, because the encoding process is executed with reference not only to the data to be encoded but also to the adjoining data, the contents of data in the edges of the divided data will be difference from that of non-divided data. Therefore, the PCM audio data is divided into the divided data having overlapping sections overlapping with previous and following divided data, and the divided data are individually encoded into the MP3 data. After encoding, the divided data are re-combined by overlapping the overlapping sections with abandoning the data in the edge in order to make the encoded data that is similar to the data encoded without dividing process. By that, the encoded data similar to the data encoded continuously can be obtained when the data is once divided.

Further, the structure of the MP3 data and the details of the division/combination of the divided data are similar to those described in the first embodiment.

Although in the above-described first to third embodiments, the process for encoding the PCM audio data to the MP3 data is described, any encoding styles that require the previous and the following data of the target data at the time of encoding can be used.

Also, although in the above-described first to third embodiments, the audio server apparatuses are used for examples, any types of apparatuses can be used. Moreover, the other process is not limited to the decoding process of the MP3 data. Furthermore, the term "encoding" represents compression in this specification, the encoding may represent a general encoding method other than the compression.

The present invention has been described in connection with the preferred embodiments. The invention is not limited only to the above embodiments. It is apparent that various modifications, improvements, combinations, and the like can be made by those skilled in the art.

What are claimed are:

1. An audio data processing apparatus, comprising:

a dividing device that partitions PCM audio data into a plurality of frames, divides the PCM audio data into a plurality of divided data and structures each of the divided data to have main data sections for the plurality of frames and overlapping sections overlapping with the plurality of frames in a previous divided data and a following divided data;

an encoder that encodes each of the divided data one by one at a variable bit rate and writes the encoded audio data continuously without a space between the frames;

an analyzer that searches frames in the overlapping sections of a present divided data and the following divided data encoded by the encoder, in which a beginning point of the encoded audio data written into the frame in the present divided data and a beginning point of the same encoded audio data written into the frame in the following divided data are closest in positions but not overlapped; and a combining device that combines the divided data at the searched frames.

2. An audio data encoding method, comprising the steps of:

(a) partitioning PCM audio data into a plurality of frames, dividing the PCM audio data into a plurality of divided data and structuring each of the divided data to have main data sections for the plurality of frames and overlapping sections overlapping with the plurality of frames in a previous divided data and a following divided data;

(b) encoding each of the divided data one by one at a variable bit rate and writing the encoded audio data continuously without a space beyond the frames;

(c) searching frames in the overlapping sections of a present divided data and the following divided data encoded in step (b), in which a beginning point of the encoded audio data written into the frame in the present divided data and a beginning point of the same encoded audio data written into the frame in the following divided data are closest in positions but not overlapped; and (d) combining the divided data at the searched frames.

3. A storage medium storing a program, which a computer executes to realize an audio data encoding program process, comprising the instructions for:

(a) partitioning PCM audio data into a plurality of frames, dividing the PCM audio data into plurality of divided data and structuring each of the divided data to have main data sections for the plurality of frames and overlapping sections overlapping with the plurality of frames in a previous divided data and the following divided data;

(b) encoding each of the divided data one by one at a variable bit rate and writing the encoded audio data continuously without space between the frames;

(c) searching frames in the overlapping sections of a present divided data and the following divided data encoded by the instruction (b), in which a beginning point of the encoded audio data written into the frame in the present divided data and a beginning point of the same encoded audio data written into the frame in the following divided data are closest in positions but not overlapped; and (d) combining the divided data at the searched frames.

4. An audio data processing apparatus, comprising:

a dividing device that partitions PCM audio data into a plurality of frames, divides the PCM audio data into a plurality of divided data and structures each of the divided data to have main data sections for the plurality of frames and overlapping sections overlapping with the plurality of frames in a previous divided data and a following divided data;

a plurality of processors that encode each of the divided data one by one at a variable bit rate, write the encoded audio data continuously without a space beyond the frames and execute an other process;

an analyzer searches frames in the overlapping sections of a present divided data and the following divided data encoded by the plurality of processors, in which a beginning point of the encoded audio data written into the frame in the present divided data and a beginning point of the same encoded audio data written into the frame in the following divided data are closest in positions but not overlapped;

a combining device that combines the divided data at the searched frames when all of the divided data have been encoded; and a management device that watches operation statuses of the plurality of processors and when a free processor executing no process is found, controls the free processor to execute the encoding process of the divided data.

5. An audio data processing apparatus according to claim 4, further comprising a controller that stops one of the plurality of processors to encode the divided data in order to make the processor execute the other process when the detector detects no free process when there is a request for the other process.

6. An audio data processing apparatus according to claim 5, wherein the other process is a decoding process of the encoded audio data.

7. An audio data processing method, comprising the steps of:

(a) partitioning PCM audio data into a plurality of frames, dividing the PCM audio data into a plurality of divided data, and structuring each of the divided data to have main data sections for the plurality of frames and overlapping sections overlapping with the plurality of frames in a previous divided data and a following divided data;

(b) controlling a plurality of processors that encodes the divided data and executes a process to encode each of the divided data one by one at a variable bit rate, to write the encoded audio data continuously without a space beyond the frames and to execute an other process;

(c) searching frames in the overlapping sections of a present divided data and the following divided data encoded by the plurality of processors, in which a beginning point of the encoded audio data written into the frame in the present divided data and a beginning point of the same encoded audio data written into the frame in the following divided data are closest in positions but not overlapped;

(d) combining the divided data at the searched frames when all of the divided data have been encoded; and (e) watching operation statuses of the plurality of processors and when a free processor executing no process is found, controlling the free processor to execute the encoding process of the divided data.

8. A storage medium storing a program, which a computer executes to realize an audio data processing program, comprising the instructions for:

(a) partitioning PCM audio data into a plurality of frames, dividing the PCM audio data into a plurality of divided data, and structuring each of the divided data to have main data sections for the plurality of frames and overlapping sections overlapping with the plurality of frames in a previous divided data and a following divided data;

(b) controlling a plurality of processors that encodes the divided data and executes a process to encode each of the divided data one by one at a variable bit rate, to write the encoded audio data continuously without a space beyond the frames and execute an other process;

(c) searching frames in the overlapping sections of a present divided data and the following divided data encoded by the plurality of processors, in which a beginning point of the encoded audio data written into the frame in the present divided data and a beginning point of the same encoded audio data written into the frame in the following divided data are closest in positions but not overlapped;

(d) combining the divided data at the searched frames when all of the divided data have been encoded; and (e) watching operation statuses of the plurality of processors and when a free processor executing no process is found, controlling the free processor to execute the encoding process of the divided data.

9. An audio data distributing apparatus, comprising:

a dividing device that partitions PCM audio data into a plurality of frames and divides audio data into a plurality of divided data, each including the plurality of frames;

an encoding device that encodes each of the divided data at a distinct bit rate by a common coding type;

a transmitter that transmits the encoded divided data to a communication network;

a detecting device that detects a condition of the communication network; and an instructor that instructs a bit rate suited for the detected conditions of the communication network to the encoder at a time of encoding each of the divided data wherein the encoder encodes PCM audio data to MP3 data and writes the encoded audio data continuously without a space beyond the frames, the dividing device partitioandns PCM audio data into a plurality of frames and structures each of the divided data to have main data sections for the plurality of frames and overlapping sections overlapping with the plurality of frames in a previous divided data and a following divided data, and the audio data distributing apparatus further includes:

an analyzer that searches frames in the overlapping sections of a present divided data and the following divided data encoded by the encoder, in which a beginning point of the encoded audio data written into the frame in the present divided data and a beginning point of the same encoded audio data written into the frame in the following divided data are closest in positions but not overlapped; and a combining device that combines the divided data at the searched frames to create combined data and supplies the combined data to the transmitter.

10. An audio data distributing method, comprising the steps of:

(a) partitioning PCM audio data into a plurality of frames and dividing audio data into a plurality of divided data, each including the plurality of frames;

(b) encoding each of the divided data at a distinct bit rate by a common coding type;

(c) transmitting the encoded divided audio data to a communication network;

(d) detecting a condition of the communication network; and (e) instructing a bit rate suited for the detected conditions of the communication network to the encoder at a time of encoding each of the dividing data, wherein the step (b) encodes PCM audio data to MP3 data and writes the encoded audio data continuously without a space beyond the frames, and the step (a) partitions PCM audio data into a plurality of frames, and structures each of the divided data to have main data sections for the plurality of frames and overlapping sections overlapping with the plurality of frames in a previous divided data and a following divided data, and the audio data distributing method further includes the steps of:

(f) searching frames in the overlapping sections of a present divided data and a following divided data encoded by the encoder, in which a beginning point of the encoded audio data written into the frame in the present divided data and a beginning point of the same encoded audio data written into the frame in the following divided data are closest in positions but not overlapped; and (g) combining the divided data at the searched frames to create combined data and supplying the combined data to the step (c).

11. A storage medium storing a program, which a computer executes to realize an audio data distributing process, comprising the instructions for:

(a) partitioning PCM audio data into a plurality of frames and dividing audio data into a plurality of divided data, each including the plurality of frames;

(b) encoding each of the divided data at a distinct bit rate by a common coding type;

(c) transmitting the encoded divided audio data to a communication network;

(d) detecting a condition of the communication network; and (e) instructing a bit rate suited for the detected conditions of the communication network to the encoder at a time of encoding each dividing data wherein the step (b) encodes PCM audio data to MP3 data and writes the encoded audio data continuously without a space beyond the frames, and the step (a) partitions PCM audio data into a plurality of frames, and structures each of the divided data to have main data sections for the plurality of frames and overlapping sections overlapping with the plurality of frames in a previous divided data and a following divided data, and the audio data distributing method further includes the steps of:

(f) searching frames in the overlapping sections of a present divided data and the following divided data encoded by the encoder, in which a beginning point of the encoded audio data written into the frame in the present divided data and a beginning point of the same encoded audio data written into the frame in the following divided data are closest in positions but not overlapped; and (g) combining the divided data at the searched frames to generate combined data and supplying the combined data to the step (c).

* * * * *